US007464927B2

(12) United States Patent
Ito et al.

(10) Patent No.: US 7,464,927 B2
(45) Date of Patent: Dec. 16, 2008

(54) SHEET-FEEDING CASSETTE AND IMAGE FORMING APPARATUS

(75) Inventors: Yoshiyuki Ito, Nagoya (JP); Makoto Hattori, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 413 days.

(21) Appl. No.: 11/288,330

(22) Filed: Nov. 29, 2005

(65) Prior Publication Data

US 2006/0113723 A1 Jun. 1, 2006

(30) Foreign Application Priority Data

Nov. 30, 2004 (JP) ..... 2004-347645

(51) Int. Cl.
*B65H 1/00* (2006.01)

(52) U.S. Cl. ..... 271/171; 271/145; 271/162; 271/169

(58) Field of Classification Search ..... 271/162, 271/171, 145, 169
See application file for complete search history.

(56) References Cited

U.S. PATENT DOCUMENTS

| | | | | |
|---|---|---|---|---|
| 5,029,841 | A * | 7/1991 | Ettischer et al. | 271/171 |
| 5,199,695 | A * | 4/1993 | Nakahata et al. | 271/9.12 |
| 5,611,528 | A * | 3/1997 | Nakamura et al. | 271/164 |
| 5,823,522 | A * | 10/1998 | Fujiwara et al. | 271/4.08 |
| 5,901,952 | A * | 5/1999 | Hourtash | 271/171 |
| 5,927,707 | A * | 7/1999 | Miura | 271/171 |
| 5,931,456 | A * | 8/1999 | Laidlaw | 271/171 |
| 6,014,229 | A * | 1/2000 | Yun | 358/449 |
| 6,267,371 | B1 * | 7/2001 | Jessop | 271/171 |
| 2003/0151188 | A1 * | 8/2003 | Imahara | 271/171 |
| 2005/0062218 | A1 * | 3/2005 | Murakami et al. | 271/171 |
| 2005/0133983 | A1 * | 6/2005 | Jacobs et al. | 271/145 |
| 2006/0082044 | A1 * | 4/2006 | Aida | 271/145 |

FOREIGN PATENT DOCUMENTS

| | | |
|---|---|---|
| JP | A 1-209227 | 8/1989 |
| JP | A 7-157100 | 6/1995 |
| JP | A 2000-128362 | 5/2000 |
| JP | A 2001-80755 | 3/2001 |
| JP | A 2004-107009 | 4/2004 |
| JP | A 2005-41646 | 2/2005 |

* cited by examiner

*Primary Examiner*—Patrick H Mackey
*Assistant Examiner*—Prasad V Gokhale
(74) *Attorney, Agent, or Firm*—Oliff & Berridge, PLC

(57) ABSTRACT

A sheet-feeding cassette includes: a stacking member including first engaging sections and second engaging sections provided at intervals which are smaller than those of the first engaging sections; and a regulatory member regulating the position of sheets, the regulatory member including an operation section that is operated at the time of movement of the regulatory member and is capable of being displaced, a first engaged section that is capable of engaging with the first engaging sections and is elastically deformable, and a second engaged section that is capable of engaging with the second engaging sections. The second engaged section is displaced in a direction so as to be disengaged from the second engaging sections in accordance with displacement of the operation section, and the first engaged section is elastically deformed as a result of being interlocked with the second engaged section according to displacement of the operation section.

19 Claims, 16 Drawing Sheets

SHEET-FEEDING CASSETTE AND IMAGE FORMING APPARATUS

CROSS REFERENCE TO RELATED APPLICATION

This application claims priority from Japanese Patent Application No. 2004-347645, filed on Nov. 30, 2004, the entire subject matter of which is incorporated herein by reference.

TECHNICAL FIELD

The present invention relates to a sheet-feeding cassette and an image forming apparatus.

BACKGROUND

A sheet-feeding cassette such as that disclosed in, e.g., JP-A-1-209227 (FIGS. 11 and 12), has hitherto been provided as a sheet-feeding cassette for use in an image forming apparatus such as a laser printer. According to this technique, a cassette main body 21*a* of a sheet cassette has sawtooth-shaped recess sections 84 used for regulating the position of a sheet guide 82, and recesses 88 corresponding to widths of sheets of standardized sizes. The sheet guide 82 is provided with wedge-shaped engagement pieces 85 capable of engaging with the recess sections 84 of the cassette main body 21, and protuberances 89 capable of engaging with the recesses 88. During movement of the sheet guide, the cassette main body is lifted so as to disengage the recess section 84 from the engaging piece 85, whereby the position of the sheet guide is adjusted.

SUMMARY

By means of the related-art configuration such as that disclosed in JP-A-1-209227, when the sheet guide 82 is moved to the position corresponding to a specific sheet size, the user can be informed by a tactile feel. Thus, an attempt to enhance operability has been made. However, when the sheet guide 82 is moved, the sheet guide 82 must be lifted so as to disengage the recess section 84 from the engaging piece 85. In this regard, the sheet cassette is problematically inferior in terms of operability. Specifically, in the configuration of JP-A-1-209227, when an attempt is made to cancel engagement for positioning purpose (i.e., engagement between the recess section 84 and the engaging piece 85) by upward operation, the elastic arm having the protuberance 89 undergoes upward pulling action. Thus, a spring characteristic in a direction where the protuberance 89 engages with the recess 88 is diminished, which in turn hinders provision of an appropriate tactile feel.

Aspects of the present invention provides a sheet-feeding cassette having a regulatory member for regulating the position of a sheet for which an attempt has been made to facilitate positioning of the regulatory member to a desired location and enhance operability pertaining to operation for moving the regulatory member.

According to an aspect of the present invention, there is provided a sheet-feeding cassette including: a stacking member being capable of stacking a plurality of sheets, the stacking member including first engaging sections provided at intervals corresponding to sizes of the sheets to be stacked, and second engaging sections provided at intervals which are smaller than those of the first engaging sections; and a regulatory member being movable with respect to the stacking member, the regulatory member regulating the position of the sheets, the regulatory member including an operation section that is operated at the time of movement of the regulatory member and is capable of being displaced, a first engaged section that is capable of engaging with the first engaging sections and is elastically deformable, and a second engaged section that is capable of engaging with the second engaging sections; wherein the second engaged section is displaced in a direction so as to be disengaged from the second engaging sections in accordance with displacement of the operation section; and the first engaged section is elastically deformed as a result of being interlocked with the second engaged section according to displacement of the operation section, such that urging force exerted on the first engaging sections becomes stronger.

According to the aspect of the invention, there can be realized a configuration which enables reliable positioning of the regulatory member by means of engagement of the second engaging section with the second engaged section. Meanwhile, when the regulatory member is moved by canceling the engagement, the regulatory member can be moved while being tentatively held in the position corresponding to the paper size, by means of engagement between the first engaging section and the first engaged section. Hence, the guide member can be easily set to the position of a desired paper size. The urging force on the first engaging section exerted by the first engaged section is increased in conjunction with disengagement of the second engaged section. Hence, stable tentative holding becomes possible, and the operator can set the guide member while acquiring a positive feel of tentative holding (i.e., an appropriate tactile feel).

BRIEF DESCRIPTION OF THE DRAWINGS

Illustrative aspects of the invention may be more readily described with reference to the accompanying drawings.

DETAILED DESCRIPTION

An embodiment of the present invention will now be described by reference to FIGS. 1 through 16.

1. Overall Configuration

Figure 1:
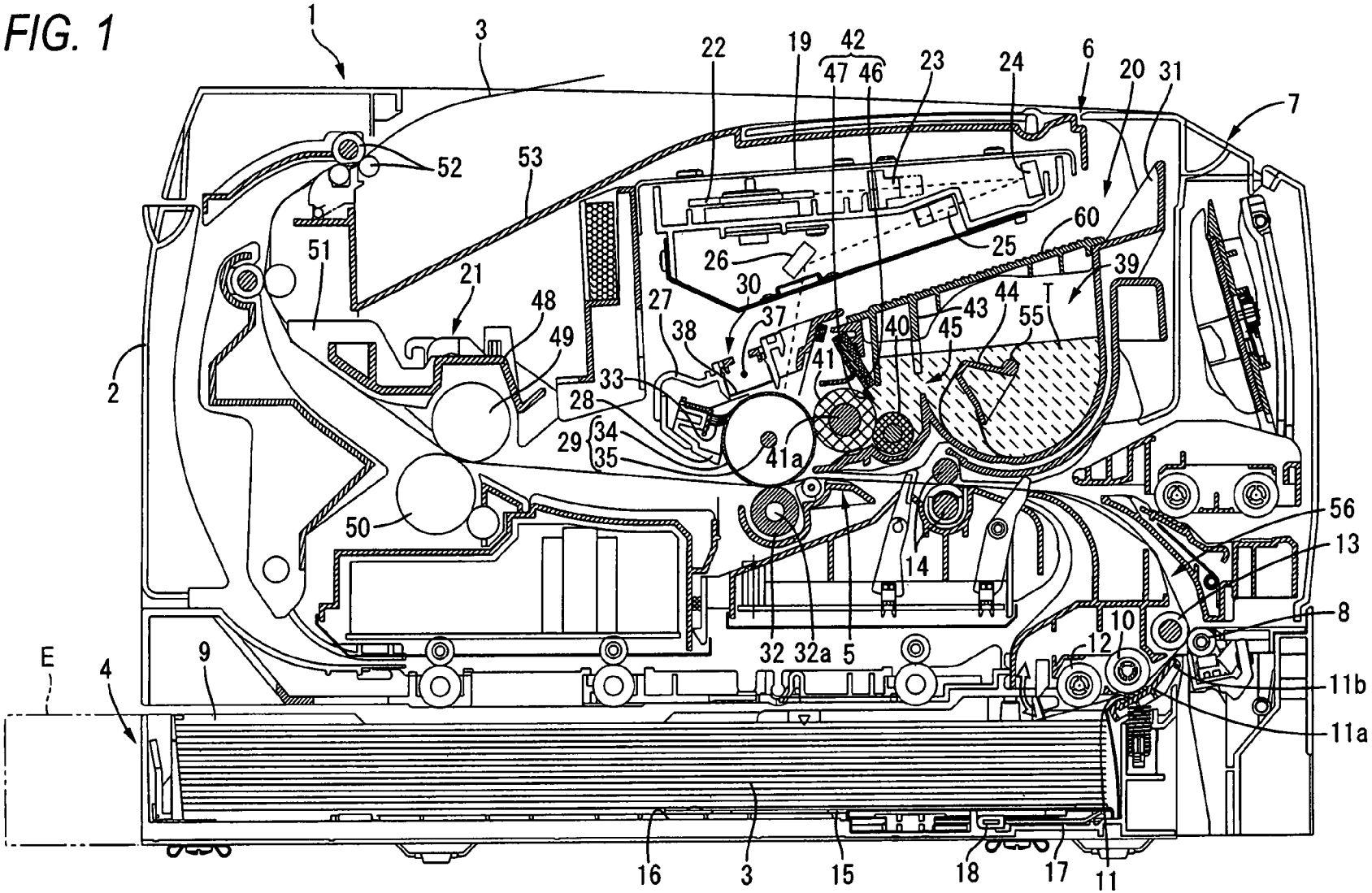
FIG. 1 is a cross-sectional view of a principal section, showing a laser printer according to an embodiment of the present invention.

FIG. 1 is a side cross-sectional view of a principal section, showing a laser printer employed as an image forming apparatus according to an embodiment of the present invention. This laser printer 1 has a main body casing 2; a feeder section 4 which is housed in the main body casing 2 and feeds sheets 3 employed as recording media; an image-forming section 5 for forming an image on the fed sheet 3, and the like.

(1) Main Body Casing

Figure 2:
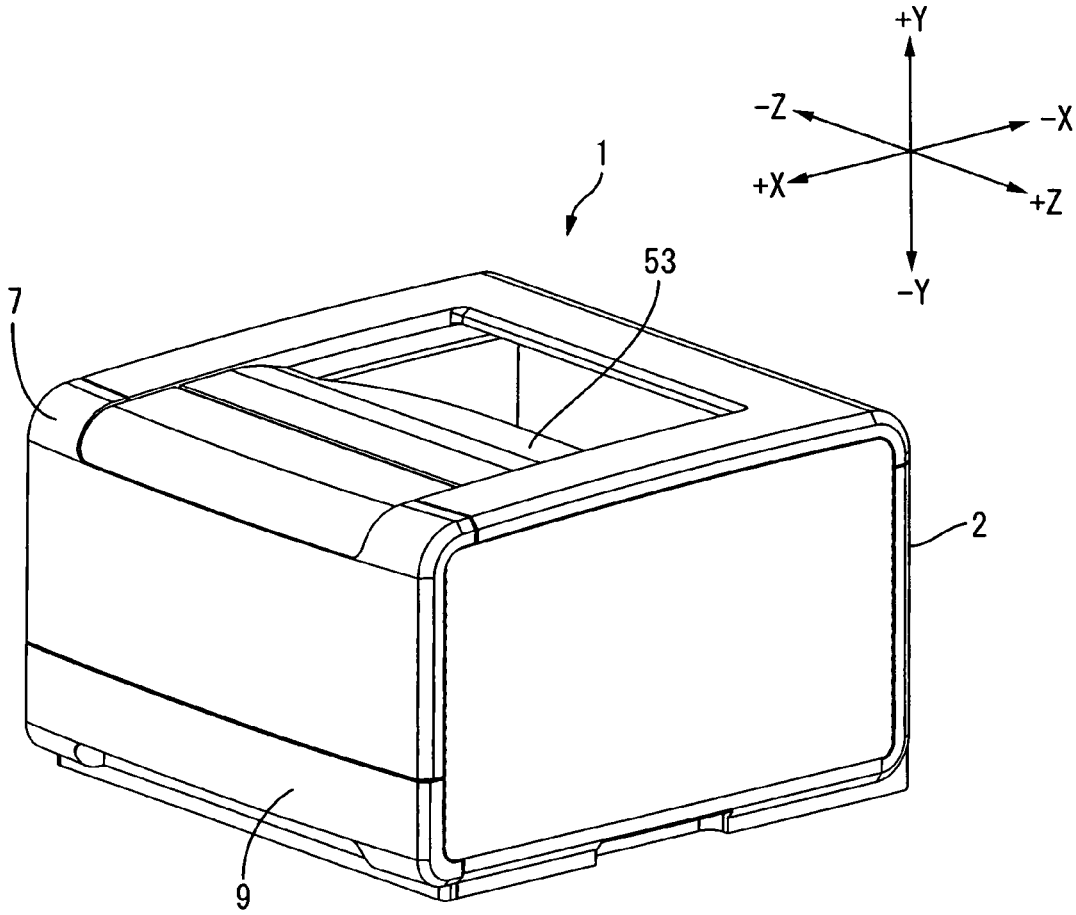
FIG. 2 is a perspective view of the laser printer shown in FIG. 1.

An attachment-and-detachment port 6 used for removing and attaching a process cartridge 20 to be described later is formed in one of walls of the main body casing 2. As shown in FIGS. 1 and 2, a front cover 7 used for opening/closing the attachment-and-detachment port 6 is provided. The front cover 7 is supported so as to be pivotable about a cover shaft (not shown) inserted into a lower end of the front cover. As shown in FIG. 1, when the front cover 7 is pivoted about the cover shaft in a closing manner, the attachment-and-detachment port 6 is closed by the front cover 7. In contrast, when the front cover 7 is pivoted (tilted) in an opening manner while the cover shaft is taken as a fulcrum, the attachment-and-detachment port 6 is opened, so that the process cartridge 30 can be removably attached to the main body casing 20 by way of the attachment-and-detachment port 6.

In the following description, with the process cartridge 20 being attached to the main body casing 2, the part of the main body casing where the front cover 7 is provided (namely, the +X side with reference to the direction of an X axis in FIG. 2) is taken as a front side, whilst the other part of the same is taken as a rear side.

(2) Feeder Section

The feeder section 4 has a sheet-feeding cassette 9 removably attached to a bottom section within the main body section 2; a separation roller 10 and a separation pad 11, which are provided at positions above a front end portion of the sheet-feeding cassette 9; and a sheet-feeding roller 12 provided on the rear of the separation roller 10 (at a position upstream of the separation pad 11 with respect to a transport direction of the sheet 3). The feeder section 4 also has a paper dust removal roller 8 disposed at a position above and forward of the separation roller 10 (a position downstream of the separation roller with respect to the transport direction of the sheet 3) so as to oppose the separation roller 10; and an opposing roller 13 disposed opposite the paper dust removal roller 8.

The transport path of the sheet 3 is folded rearward into the shape of the letter U from the neighborhood of the location where the paper dust removal roller 8 is disposed. A registration roller 14 consisting of a pair of rollers is provided at a position below the process cartridge 20 and further downstream of the folded area with respect to the transport direction.

A sheet-pressing plate 15 which enables loading of the sheets 3 in a stacked manner is provided in the sheet-feeding cassette 9. A rear end portion of the sheet-pressing plate 15 is supported in a swayable manner between a loading position (shown in FIG. 1) where a front end portion of the sheet-pressing plate 15 is situated downward against a bottom plate 16 of the sheet-feeding cassette 9, and a feeding position (shown in FIGS. 4 and 6) where the front end portion is situated upward in an inclined manner.

A lever 17 used for lifting the front end portion of the sheet-pressing plate 15 is provided at the front end portion of the sheet-feeding cassette 9. A rear end portion of this lever 17 is swayably supported by a lever shaft 18 at a position below the front end portion of the sheet-pressing plate 15. The lever 17 is swayable between a face-down position (shown in FIG. 1) where the front end portion of the lever 17 faces downward against the bottom plate 16 of the sheet-feeding cassette 9 and an inclined position (omitted from the drawing) where the front end portion of the lever 17 lifts the sheet-pressing plate 15. When rotational driving force, which is counterclockwise in the drawing, is input to the lever shaft 18, the lever 17 rotates while taking the lever shaft 18 as a fulcrum, whereby the front end portion of the lever 17 lifts the front end portion of the sheet-pressing plate 15, thereby moving the sheet-pressing plate 15 to the feeding position.

When the sheet-pressing plate 15 has come to the feeding position, the sheets 3 on the sheet-pressing plate 15 are pressed against the sheet-feeding roller 12. By means of rotation of the sheet-feeding roller 12, feeding of a sheet toward a separation position between the separation roller 10 and the separation pad 11 is initiated. As indicated by a phantom line E shown in FIG. 1, the sheet-feeding cassette 9 is made usable when being extended rearward of the apparatus main body (i.e., in a condition of being used, such as that shown in FIGS. 3 and 4, which will be described later).

Meanwhile, when the sheet-feeding cassette 9 is detached from the main body casing 2, the front end portion of the sheet-pressing plate 15 moves downward under its own weight, whereupon the sheet-pressing plate 15 comes to the loading position. When the sheet-pressing plate 15 has come to the loading position, the sheets 3 can be loaded on the sheet-pressing plate 15 in a stacked manner. The separation pad 11, the paper dust removal roller 8, the sheet-pressing plate 15, and the lever 17 are provided on the sheet-feeding cassette 9. The paper-feeding roller 12, the separation roller 10, the opposing roller 13, and the registration roller 14 are provided on the main body casing 2.

When being nipped between the separation roller 10 and the separation pad 11, the sheets 3 sent toward the separation position by the sheet-feeding roller 12 are separately fed one sheet at a time by means of rotation of the separation roller 10. The thus-fed sheet 3 is turned back along the U-shaped transport path 56. More specifically, the fed sheet 3 first passes between the separation roller 10 and the separation pad 11, and is transported upward. Further, the sheet 3 is subjected to removal of paper dust while passing between the paper dust removal roller 8 and the opposing roller 13, and is then transported to the registration roller 14.

After having registered the sheet 3, the registration roller 14 transports the sheet 3 to a transfer position between a photosensitive drum 29 and a transfer roller 32, which will be described later, where a toner image on the photosensitive drum 29 is transferred to the sheet 3.

(3) Image-forming Section

The image-forming section 5 comprises a scanner section 19, the process cartridge 20, and a fixing section 21.

(a) Scanner Section

The scanner section 19 is disposed at a higher position within the main body casing 2, and includes an unillustrated laser light source, a polygon mirror 22 which is rotationally driven, an fθ lens 23, a reflection mirror 24, a lens 25, a reflection mirror 26, and the like. The laser beam that has been emitted from a laser light source in accordance with image data is deflected by the polygon mirror 22 as indicated by a chain line. After the laser beam has passed through the fθ lens 23, an optical path of the laser beam is turned back by the reflection mirror 24. After the laser beam has further passed through the lens 25, the optical path of the laser beam is further bent downward by the reflection mirror 26, to thus fall on the surface of the photosensitive drum 29, which will be described later, of the process cartridge 20.

(b) Process Cartridge

The process cartridge 20 is removably attached to the main body casing 2 at a position below the scanner section 19. The process cartridge 20 has, as an enclosure, an upper frame 27, and a lower frame 28, which is formed separately from the upper frame 27 and is to be combined with the upper frame 27. The process cartridge 20 includes, in the enclosure, the photosensitive drum 29 serving as an image carrier, a scorotron charger 30, a development cartridge 31, the transfer roller 32, and a cleaning brush 33.

The photosensitive drum 29 has a drum main body 34 which assumes a cylindrical shape and whose outermost surface is formed from a positively-charged photosensitive layer made from polycarbonate, or the like; and a metal drum shaft 35 serving as a shaft which extends along the axis of the drum main body 34 in the longitudinal direction thereof. The drum shaft 35 is supported by the upper frame 27, and the drum main body 34 is supported so as to be rotatable about the drum shaft 35, whereby the photosensitive drum 29 is provided on the upper frame 27 so as to be rotatable about the center of the drum shaft 35.

The scorotron charger 30 is supported by the upper frame 27, and is disposed at an upper position obliquely rearward of the photosensitive drum 29 so as to oppose the photosensitive drum 29 with a predetermined distance therefrom so as not to come into contact with the photosensitive drum 29. This scorotron charger 30 has a discharge wire 37 disposed opposite the photosensitive drum 29 with a predetermined interval therebetween; and a grid 38 which is interposed between the discharge wire 37 and the photosensitive drum 29 and controls the level of electric discharge from the discharge wire 37 to the photosensitive drum 29. The scorotron charger 30 applies a high voltage to the discharge wire 37 simultaneously with application of a bias voltage to the grid 38, to thus cause the discharge wire 37 to effect corona discharge. Thus, the surface of the photosensitive drum 29 can be positively charged in a uniform manner.

The development cartridge 31 has a box-shaped housing case 60 whose rear portion is opened, and is removably attached to the lower frame 28. A toner storage chamber 39, a toner-feeding roller 40, a development roller 41, and a layer thickness regulatory blade 42 are provided within the development cartridge 31.

The toner storage chamber 39 is formed as a front internal space of the housing case 60 partitioned by a partition plate 43. The toner storage chamber 39 is filled with positively-charged nonmagnetic mono-component toner T serving as a developing agent. Polymeric monomer, e.g., a styrene-based monomer, such as styrene, and an acrylic monomer such as an acrylic acid, alkyl (C1 to C4) acrylate, or alkyl (C1 to C4) meta-acrylate are copolymerized by suspension polymerization, to thus obtain polymer toner. The thus-obtained polymer toner is used as the toner T. This polymer toner assumes an essentially-spherical shape, exhibits extremely superior fluidity, and enables formation of a high-quality image.

The toner is formulated with a coloring agent, such as carbon black, and wax, and an external additive, such as silica, is added to the toner with a view toward enhancing fluidity. The average particle size of the toner is about 6 to 10 μm.

An agitator 44 supported by a rotary shaft 55 disposed in the center of the toner storage chamber 39 is provided in the toner storage chamber 39. This agitator 44 is rotationally driven by an input of power from an unillustrated motor. When the agitator 44 is rotationally driven, the toner T in the toner storage chamber 39 is stirred and discharged toward the toner-feeding roller 40 by way of an opening section 45 which is formed in a lower portion of the partition plate 43 to thus form a longitudinal passage. A window member (not shown) is attached to each of areas on both side walls of the housing case 60, wherein the areas respectively correspond to the toner storage chamber 39. The respective windows are cleaned by wipers which are held by the agitator 44 and actuated synchronously. In the main body casing 2, a light-emitting element (not shown) is provided outside of one window member, and a light-receiving element (not shown) is provided outside of the other window member. Detection light that has been emitted from the light-emitting element and passed through the inside of the housing case 60 is detected by the light-receiving element 60, and presence/absence of the toner T is determined in accordance with an output value from the light-receiving element.

The toner-feeding roller 40 is disposed rearward of the opening section 45, and is supported by the development cartridge 31 in a rotatable manner. The toner-feeding roller 40 is formed by covering a metal roller shaft with a roller made of a conductive foam material. This toner-feeding roller 40 is rotationally driven by an input of power from an unillustrated motor.

The development roller 41 is located rearward of the toner-feeding roller 40 and rotatably supported by the development cartridge 31 while remaining in mutually-compressed contact with the toner-feeding roller 40. The development roller 41 opposes and contacts the photosensitive drum 29 while the development cartridge 31 remains attached to the lower frame 28. The development roller 41 is formed by covering a metal roller shaft 41*a* with a roller formed from a conductive rubber material. Both ends of the roller shaft 41*a* protrude outward from side surfaces of the development cartridge 31 at the rear end portion thereof, in a lateral direction orthogonal to the longitudinal direction. The roller of the development roller 41 is formed by means of coating the surface of a roller main body formed from conductive urethane rubber or silicon rubber containing fine carbon particles, or the like, with a coating layer formed from urethane rubber or silicon rubber containing fluorine. During development operation, a development bias is applied to the development roller 41. By means of an input of power from the unillustrated motor, the development roller 41 is rotationally driven in the same direction as is the toner-feeding roller 40.

The layer thickness regulatory blade 42 has a pressing section 47 which is provided at the extremity of a blade main body 46 formed from a metal leaf spring material and is formed from insulating silicon rubber; and which assumes a semicircular cross-sectional profile. This layer thickness regulatory blade 42 is supported by the development cartridge 31 at a position above the development roller 41, and the pressing section 47 is compressed onto the development roller 41 by means of elastic force of the blade main body 46.

The toner T discharged out of the opening section 45 is fed to the development roller 41 by means of rotation of the toner-feeding roller 40. At this time, the toner is positively charged through friction between the toner-feeding roller 40 and the development roller 41. The toner T fed over the development roller 41 enters between the pressing section 47 of the layer thickness regulatory blade 42 and the development roller 41 in association with rotation of the development roller 41, and is carried over the development roller 41 as a thin layer of given thickness.

The transfer roller 32 is rotationally supported by the lower frame 28. In a state where the upper frame 27 and the lower frame 28 are combined together, the transfer roller 32 is arranged so as to oppose and contact the photosensitive drum 29 in the vertical direction, to thus form a nip between the photosensitive drum 29 and the transfer roller 32. The transfer roller 32 is formed by covering a metal roller shaft 32*a* with a roller made of a conductive rubber material. During transfer operation, a transfer bias is applied to the transfer roller 32. The transfer roller 32 is rotationally driven in a direction opposite the photosensitive drum 29 by means of an input of power from the unillustrated motor.

The cleaning brush 33 is attached to the lower frame 28. In the state where the upper frame 27 and the lower frame 28 are combined together, the cleaning brush 33 is arranged so as to oppose and contact the photosensitive drum 29 at a position rearward thereof.

In association with rotation of the photosensitive drum 29, the surface of the photosensitive drum 29 is first uniformly, positively charged by the scorotron charger 30. Subsequently, the surface is exposed to a high-speed scan of the laser beam output from the scanner section 19, thereby forming an electrostatic latent image corresponding to the image to be formed on the sheet 3.

Next, when the positively-charged toner carried on the development roller 41 opposes and contacts the photosensitive drum 29 by means of rotation of the development roller 41, the toner is fed to the electrostatic latent image formed on the surface of the photosensitive drum 29; namely, exposed areas on the uniformly, positively-charged surface of the photosensitive drum 29, electric potentials of the areas are reduced upon exposure to the laser beam. As a result, the electrostatic latent image of the photosensitive drum 29 is visualized, and a toner image formed through negative development is carried on the surface of the photosensitive drum 29.

As shown in FIG. 1, the toner image carried on the surface of the photosensitive drum 29 is transferred to the sheet 3 by means of the transfer bias applied to the transfer roller 32 within a period during which the sheet 3 transported by the registration roller 14 passes through the transfer position between the photosensitive drum 29 and the transfer roller 32. The sheet 3 on which the toner image is transferred is transported to the fixing section 21.

Transfer residual toner still remaining on the photosensitive drum 29 after transfer operation is recovered by the development roller 41. Moreover, the paper dust which has originated from the sheet 3 and is still adhering to the photosensitive drum 29 after transfer operation is recovered by the cleaning bush 33.

(c) Fixing Section

The fixing section 21 is provided rearward of the process cartridge 20 and comprises a fusing frame 48, and a heating roller 49 and a pressure roller 50, both of which are provided within the fusing frame 48.

The heating roller 49 has a metal pipe whose surface is coated with fluorine resin, and a halogen lamp for heating purpose incorporated in the metal pipe. The heating roller 49 is rotationally driven by an input of power from the unillustrated motor. Meanwhile, the pressure roller 50 is disposed at a position below the heating roller 49 so as to oppose and press the heating roller 49. The heating roller 50 is formed by means of coating a metal roller shaft with a roller made of a rubber material, and is driven in accordance with rotational driving action of the heating roller 49.

The toner transferred on the sheet 3 at the transfer position is thermally fused by the fixing section 21 during the course of the sheet 3 passing between the heating roller 49 and the pressure roller 50. The sheet 3 having the toner fused thereon is transported to a sheet output path 51 which extends vertically toward the upper surface of the main body casing 2. The sheet 3 transported to the sheet output path 51 is output to a sheet output tray 53 formed in the upper surface of the main body casing 2, by means of a sheet output roller 52 disposed at a position above the paper output path 51.

2. Sheet-Feeding Cassette

The sheet-feeding cassette will now be described by reference to FIGS. 3 through 8.

Figure 3:
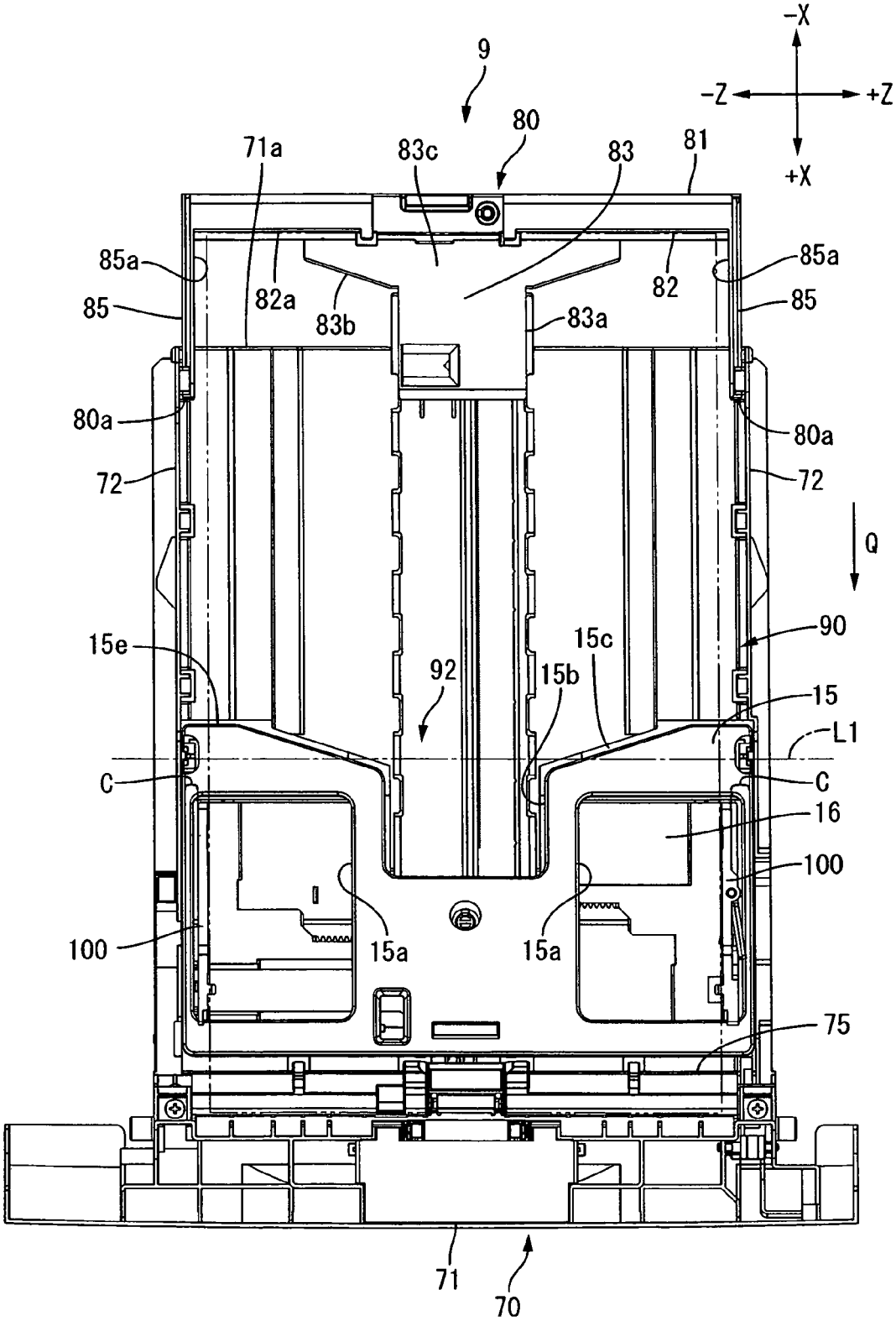
FIG. 3 is a plan view illustrating a size-enlarged state of a sheet-feeding cassette of the embodiment.

(1) Configuration Pertaining to Extension/Contraction of the Sheet Housing Section As shown in FIG. 3, the sheet-feeding cassette 9 has a sheet housing section 90 where the plurality of sheets 3 are housed, and is configured such that the housed sheets 3 are separated and fed one at a time. The sheet-feeding cassette 9 has a first tray 70 and a second tray 80, and the sheet housing section 90 is formed from the first tray 70 and the second tray 80.

In the first tray 70, a first wall section 75 is provided on the downstream end portion of the sheet-housing section 90 in the sheet-feeding direction of the sheet 3 (in the direction of arrow Q). This first wall section 75 is provided opposite one end of the sheet 3 (virtually illustrated by a chain double-dashed line in FIG. 3). Upon contact with the sheets 3, the first wall section 75 regulates the position of the sheets 3 in the sheet-housing section 90. A pair of sidewalls 72, 72 are provided along side sections of the first tray 70 in the widthwise direction of the sheet (the direction of a Z axis), and the bottom plate 16 is provided beneath the sheets 3 in the first tray 70. The bottom plate 16 is provided so as to receive the sheets 3 housed in the sheet-housing section 90.

Figure 4:
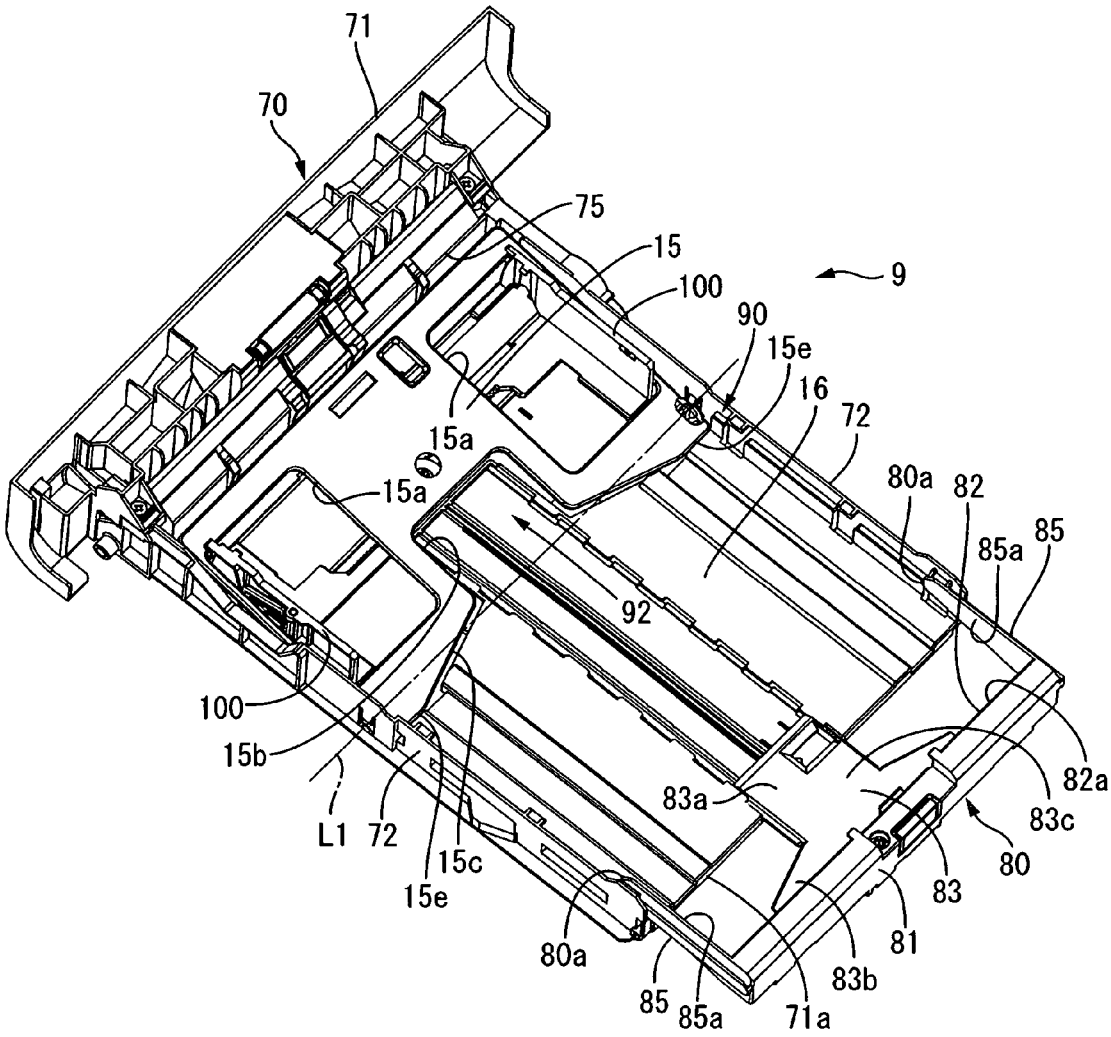
FIG. 4 is a perspective view of FIG. 3.

The second tray 80 is configured to be able to move with respect to the first tray 70, and a second wall section 82 is provided on the upstream end portion of the sheet-housing section 90 in the sheet-feeding direction Q. Upon contact with the sheets 3, the second wall section 82 relates the position of the sheets 3 in the sheet-housing section 90. As shown in FIG. 4, the sheet-housing section 90 is formed into a box shape whose upper portion is opened, from the first wall section 75, the sidewalls 72, 72, and the bottom plate 16, all of which belong to the first tray 70, as well as from the second wall section 82 belonging to the second tray 80. As a result of the second tray 80 moving in relation to the first tray 70, the interval between the first wall section 75 and the second wall section 82 is changed, which in turn changes the size of the sheet-housing section 90.

In the first tray 70, the first tray main body 71 is formed from the first wall section 75, the sidewalls 72, 72, and the bottom plate 16, all of which have been described previously. The sheet-pressing plate 15 is fixed to the first tray main body 71 in a pivotable manner. The sheet-pressing plate 15 is configured to press, against the above-described sheet-feeding roller 12 (FIG. 1), at least a downstream end portion of the sheet 3 in the sheet-feeding direction. The sheet-feeding roller 12 acts as a sheet-feeding member.

The second tray 80 is provided with a second tray main body 81 having the second wall section 82, as well as with a first coupling section 83 and a second coupling section 85 for coupling the second tray main body 81 to the first tray main body 71. As shown in FIGS. 3 and 4, the second tray 80 is made movable such that a wall surface 82*a* of the second wall section 82, which contacts the sheets, comes to a position upstream of an upstream end portion 71*a* of the first tray main body 71 in the sheet-feeding direction.

Figure 5:
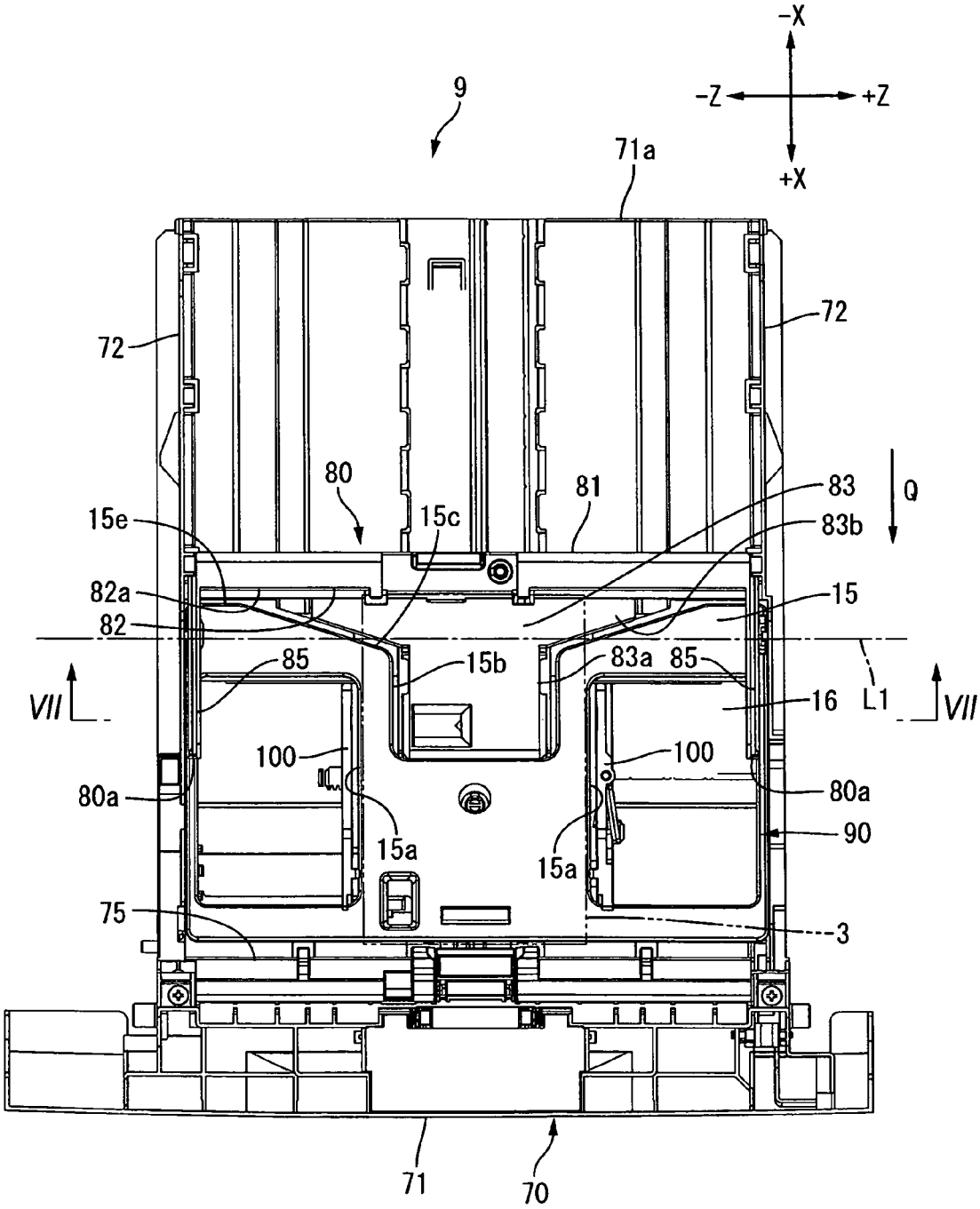
FIG. 5 is a plan view illustrating a size-enlarged state of the sheet-feeding cassette of the embodiment.

In addition to the wall surface being made movable as mentioned above, the second tray 80 is made movable relative to the first tray 70 such that a downstream end portion 80*a* in the sheet-feeding direction comes to a position downstream of an upstream end portion 15*e* of the sheet-pressing plate 15 in the sheet-feeding direction, as shown in FIG. 5.

By means of the configuration of the present embodiment, the wall surface 82*a* of the second wall section 82, which contacts the sheets 3, is made movable so as to come to a position upstream of the upstream end portion 71*a* of the first tray main body 71 in the sheet-feeding direction. Accordingly, as shown in FIG. 3, sheets, which are so large as to extend beyond the first tray 70, can be housed in the sheet-housing section 90. Moreover, since the pivotal axis L1 of the sheet-pressing plate 15 is fastened to the first tray main body 71, a positional relationship between the sheet-pressing plate 15 and the first wall section 75 is determined, and a downstream end portion of sheets guided by the first wall section 75 can be stably pressed.

As shown in FIG. 5, the downstream end portion 80*a* of the second tray 80 in the sheet-feeding direction is made movable to a position downstream of the upstream end portion 15*e* of the sheet-pressing plate 15 in the sheet-feeding direction. Therefore, the second tray 80 can be placed in a further downstream position with reference to the sheet-feeding direction Q. Consequently, the interval between the first wall section 75 and the second wall section 82 can be set to a smaller value, and the sheet-feeding cassette can cope with sheets of smaller sizes as shown in FIG. 5.

The first tray 70 is also provided with a pair of side guides 100 which oppose the edges of the sheet 3 in the widthwise direction thereof and are provided so as to be movable in a direction (i.e., the direction of the Z axis) crossing the moving direction of the second tray 80 (the direction of the X axis). As shown in FIG. 5, the second tray 80 is made movable such that the downstream end portion 80*a* of the second tray in the sheet-feeding direction comes to a position downstream of the upstream end portion of the side guide 100 in the sheet-feeding direction. As a result, the edges of various sheets of different widths in the widthwise direction thereof can be stably supported, and the second tray 80 can be moved to a further downstream position with reference to the sheet-feeding direction Q. Therefore, the sheet-feeding cassette can more appropriately cope with sheets of smaller sizes.

The second tray 80 is provided with a first coupling section 83 to be coupled with the bottom wall 16 of the first tray main body 71, and two second coupling sections 85, 85 to be coupled with the pair-of sidewalls 72, 72 provided in the first tray main body 71. By virtue of presence of the first coupling section 83 and the second coupling sections 85, 85, the second tray 80 is coupled to the bottom plate 16 and the sidewalls 72, 72 of the first tray main body 71, to thus achieve tighter coupling.

As shown in FIG. 3, the first coupling section 83 is configured to extend downstream from the second wall section 82 with respect to the sheet-feeding direction. An engaging section 83*a* to engage with the bottom plate 16 of the first tray main body 71 is provided on a lower end portion of the first coupling section 83 in the extending direction thereof. A reinforcement section 83*b*, which is wider than the engaging section 83*a*, is provided on an upstream end portion of the first coupling section 83 integrally with the second wall section 82. By means of this configuration, the first coupling section 83 and the bottom plate section 16 can be coupled together, and the strength of the first coupling section 83 is also enhanced. As shown in FIGS. 3 and 4, the first coupling section 83 has an upper surface 83*c* in a maximum enlargement section where the interval between the first wall section 75 and the second wall section 82 becomes maximum, wherein the upper surface 83*c* supports an area of the sheets 3 from below.

Figure 6:
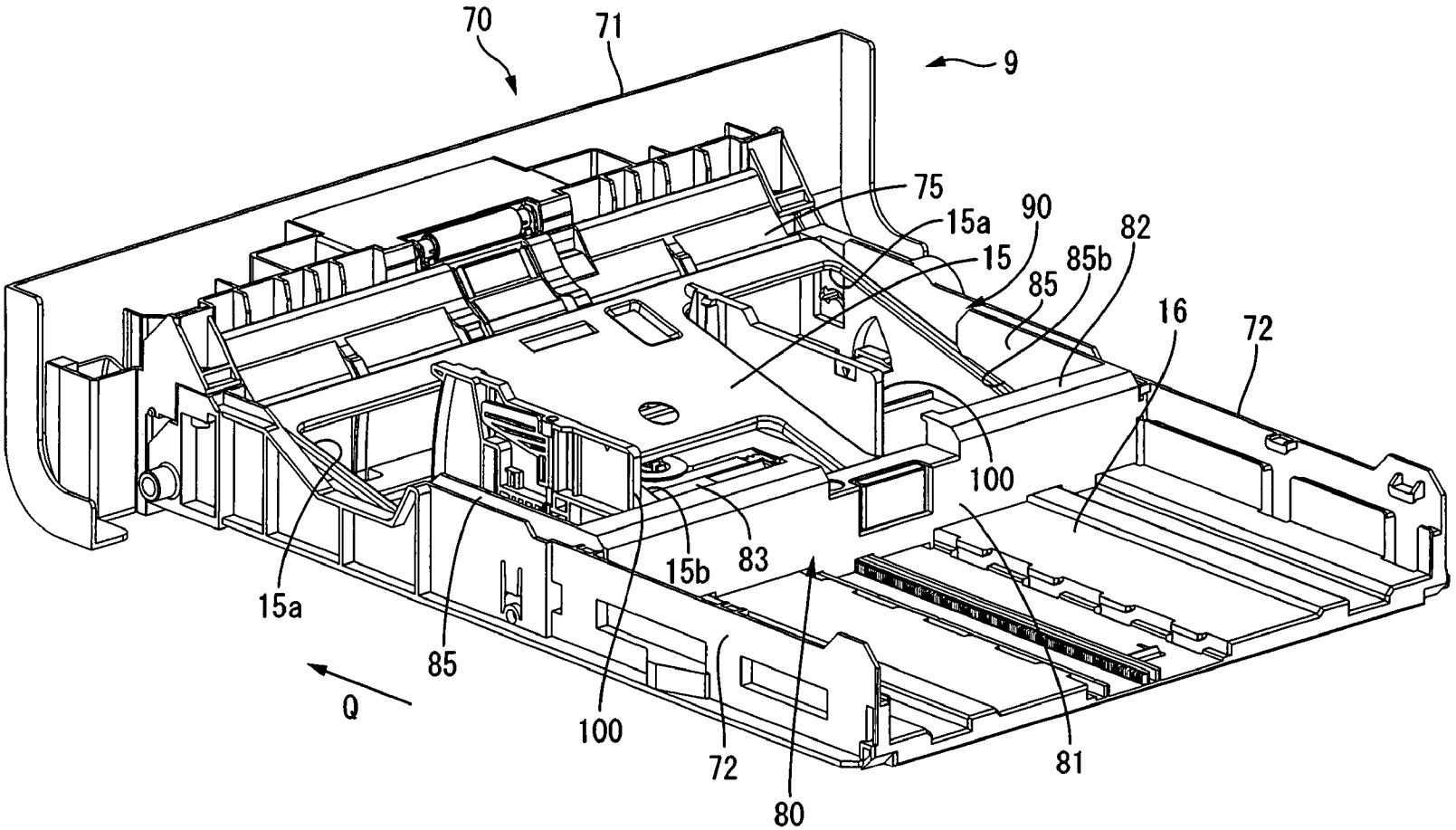
FIG. 6 is a perspective view of FIG. 5.

A recess section 92 is formed in an upstream end portion of the sheet-pressing plate 15, which is provided on the first tray 70, in the sheet-feeding direction. As shown in FIGS. 5 and 6, the first coupling section 83 can be housed in the recess section 92. Specifically, there has been conceived a contrivance that enables stable coupling by means of the first coupling section 83 and the second coupling section 85, as well as preventing the first coupling section 83 extending downward from the second wall section 82 from interfering with the sheet-pressing plate 15 even when the second wall section 82 remains close to the sheet-pressing plate 15.

The recess section 90 of the sheet-pressing plate 15 has an end-section housing section 15*b* which houses a portion of the downstream end of the first coupling section 83 in the sheet-feeding direction (i.e., the engaging section 83*a*), and a reinforcement-section housing section 15*c* which is formed so as to become wider than the end-section housing section at a position upstream of the end-section housing section 15*b* in the sheet-feeding direction. The end-section housing section 15*b* and the reinforcement-section housing section 15*c* are made in the form of cutouts in the end portion of the sheet-pressing plate 15.

As mentioned above, the second coupling section 85 is provided in a number of two. The respective second coupling sections 85 have sidewall surfaces 85*a*, 85*a* opposing the side edges of the sheets 3 in the maximum enlargement position such as that shown in FIG. 3. In such a maximum enlargement position, the upstream end portion of the sheet 3 in the sheet-feeding direction is guided by means of the wall surface 82*a* of the second wall section 82, the upper surface 83*c* of the first coupling section 83, and the sidewall surfaces 85*a*, 85*a* of the respective coupling sections 85.

As mentioned previously, the first tray 70 is provided with the side guides 100 opposing the edges of the sheets 3 in the widthwise direction thereof. However, as shown in FIG. 5, the second coupling sections 85, 85 can be housed between the sidewalls 72, 72 of the first tray main body 71 and the side guides 100, 100 with respect to the widthwise direction of the sheet. Specifically, each of the second coupling sections 85 is moved downstream by utilization of a clearance between the corresponding side guide 100 and sidewall 72. By means of this configuration, various sheets of different widths can be housed in a compact manner without causing the second coupling sections 85 to interfere with the side guides 100 while side edges of the sheets can be supported by the side guides 100. The sheet-feeding cassette can more appropriately cope with sheets of smaller sizes.

As shown in FIG. 3, the side guide 100 is configured such that outward movement of the second coupling section 85 in the widthwise direction thereof is regulated at the center rather than at the housing position where the second coupling section 85 is housed between the sidewall 72 of the first tray main body 71 and the side guide 100. Put another way, movement of the second coupling section 85 is regulated by a clearance C which enables movement of the same. As a result, the side guides 100 become difficult to hinder housing of the second coupling sections 85, and hence the second housing sections 85 are smoothly housed in the space between the side guides 100 and the sidewalls, and by extension, smooth movement of the second tray 80 becomes feasible.

Figure 7:
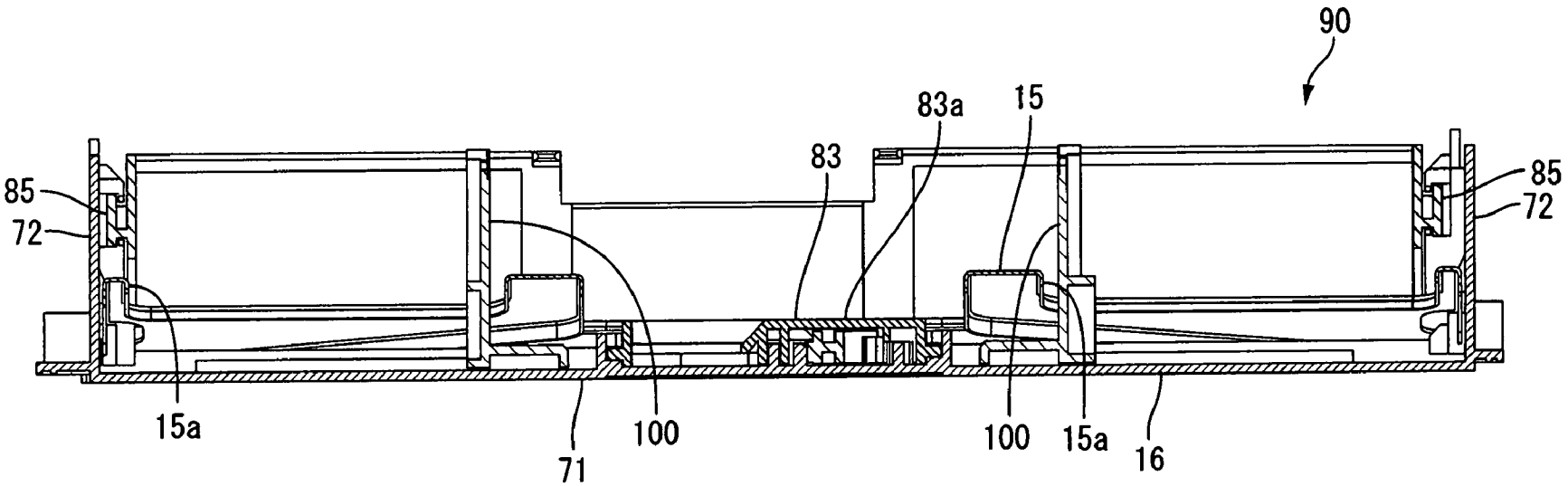
FIG. 7 is a cross-sectional view taken along VII-VII shown in FIG. 5.
Figure 8:
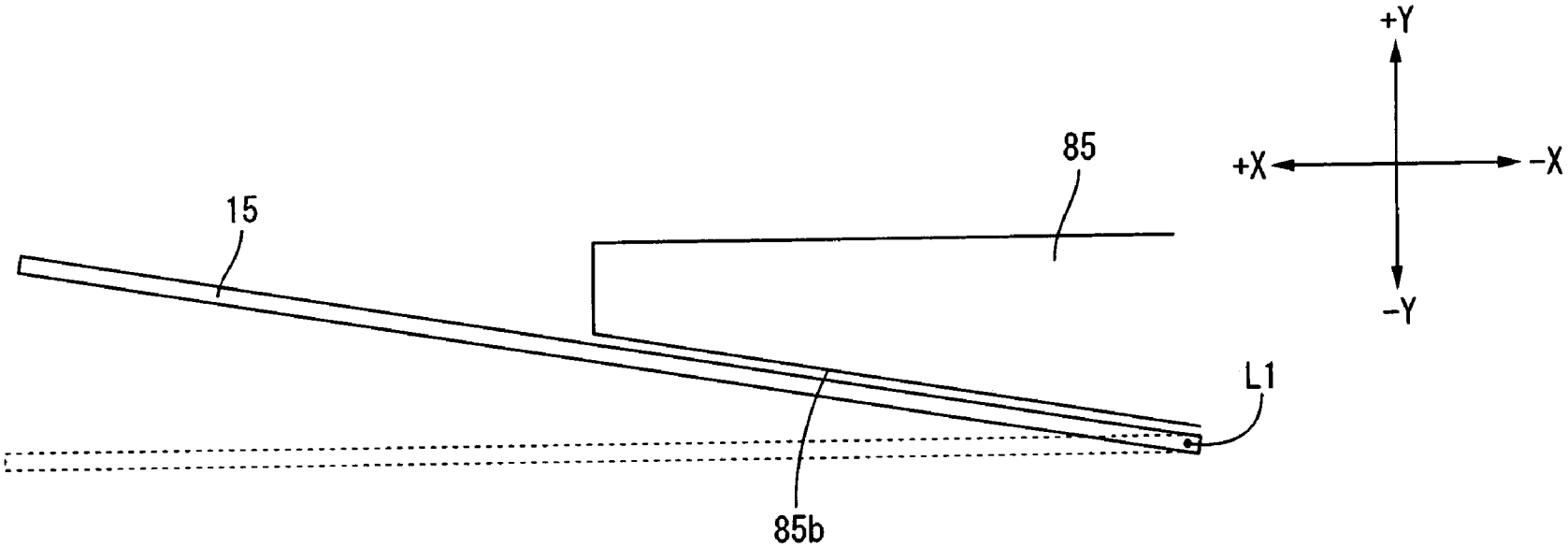
FIG. 8 is a descriptive view for describing a relationship between a sheet-pressing plate and a second coupling section.

As shown in FIGS. 6 and 7, the second coupling sections 85 can be placed in positions above the sheet-pressing plate 15 at a location downstream of the pivotal axis L1 of the sheet-pressing plate 15 in the sheet-feeding direction Q [in other words, positions where +Y is achieved in the direction of the Y axis (the heightwise direction of the image forming apparatus)]. As conceptually shown in FIG. 8, the sheet-pressing plate 15 is displaceable between a first position indicated by a broken line (a position where the upper surface of the sheet-pressing plate 15 becomes essentially parallel to the bottom plate 16) and a maximum pivotal position indicated by a solid line. As shown in FIGS. 6 and 8, a slope section 85*b* is provided on a lower end portion of each of the second coupling sections 85, wherein the angle between the second tray 80 and the bottom wall 16 becomes identical with the maximum pivotal angle between the sheet-pressing plate 15 and the bottom wall 16. By virtue of such a configuration, there can be readily realized a configuration which enables positioning of the second coupling section 85 in a location downstream of the sheet-pressing plate 15 with respect to the sheet-feeding direction and which makes pivotal motion of the sheet-pressing plate 15 not interfere with the second coupling section. Here, the same angle is adopted, but the angle between the slope section 85*b* and the bottom wall 16 becomes greater than the maximum pivotal angle between the sheet-pressing plate 15 and the bottom wall 16.

(2) Configuration Pertaining to Positioning

The configuration of the second tray and the configuration for positioning side guides will now be described by reference to FIGS. 9 to 16.

1. Positioning of the First and Second Tray Main Bodies

Figure 9:
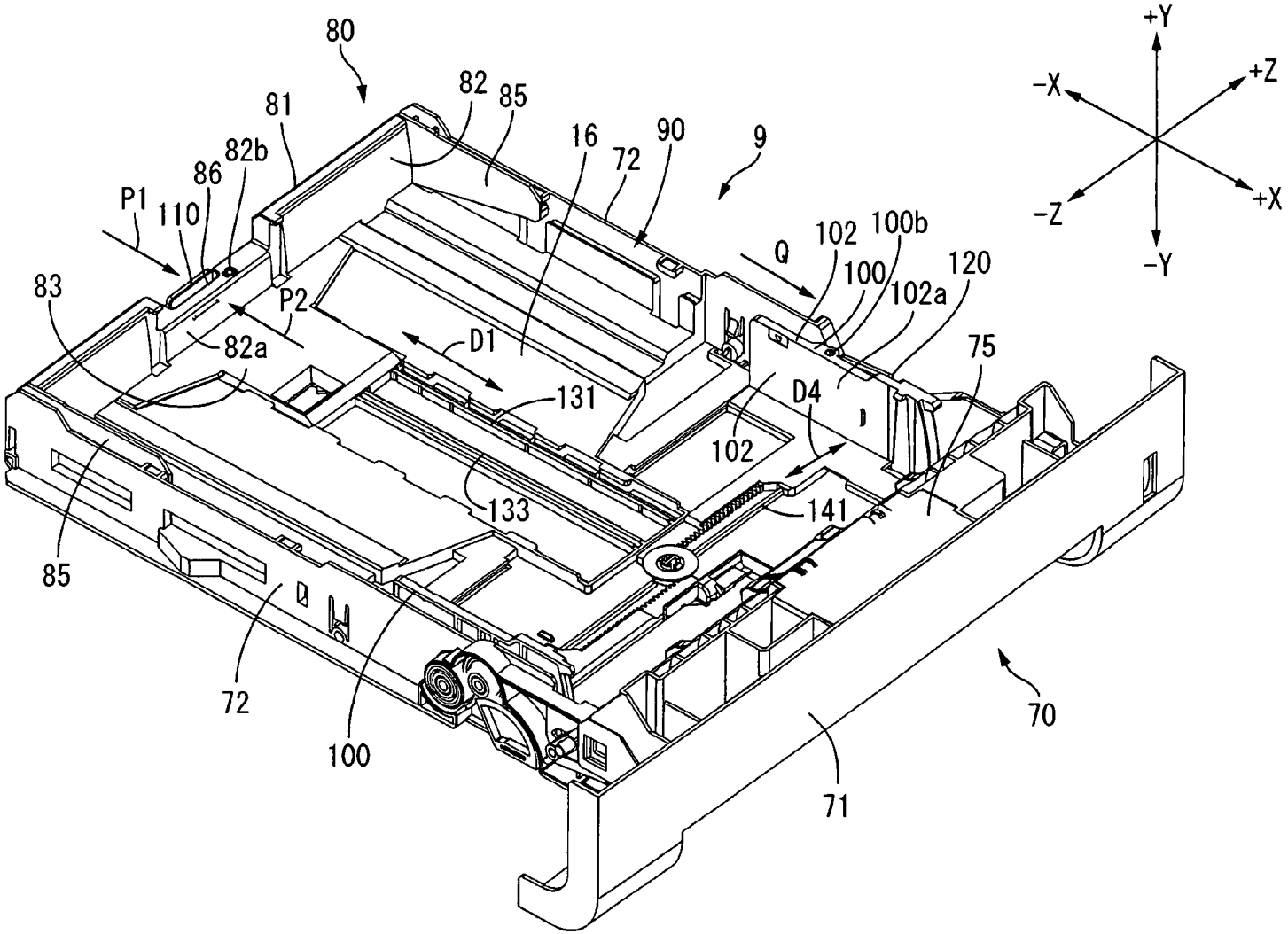
FIG. 9 is a perspective view of the sheet-feeding cassette when viewed from a downstream position with respect to a sheet-feeding direction.
Figure 10:
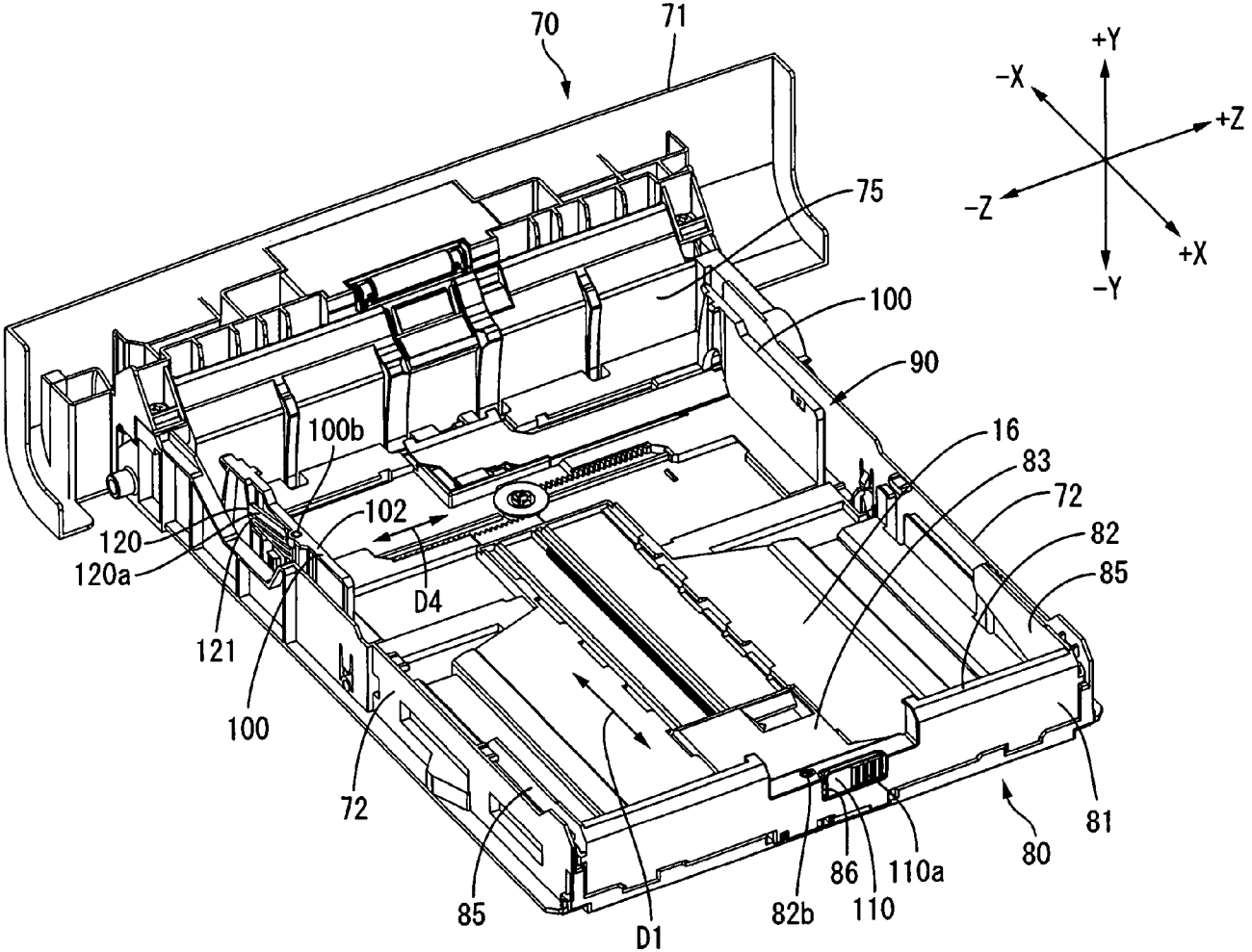
FIG. 10 is a perspective view of the sheet-feeding cassette when viewed from an upstream position with respect to the sheet-feeding direction.
Figure 11:
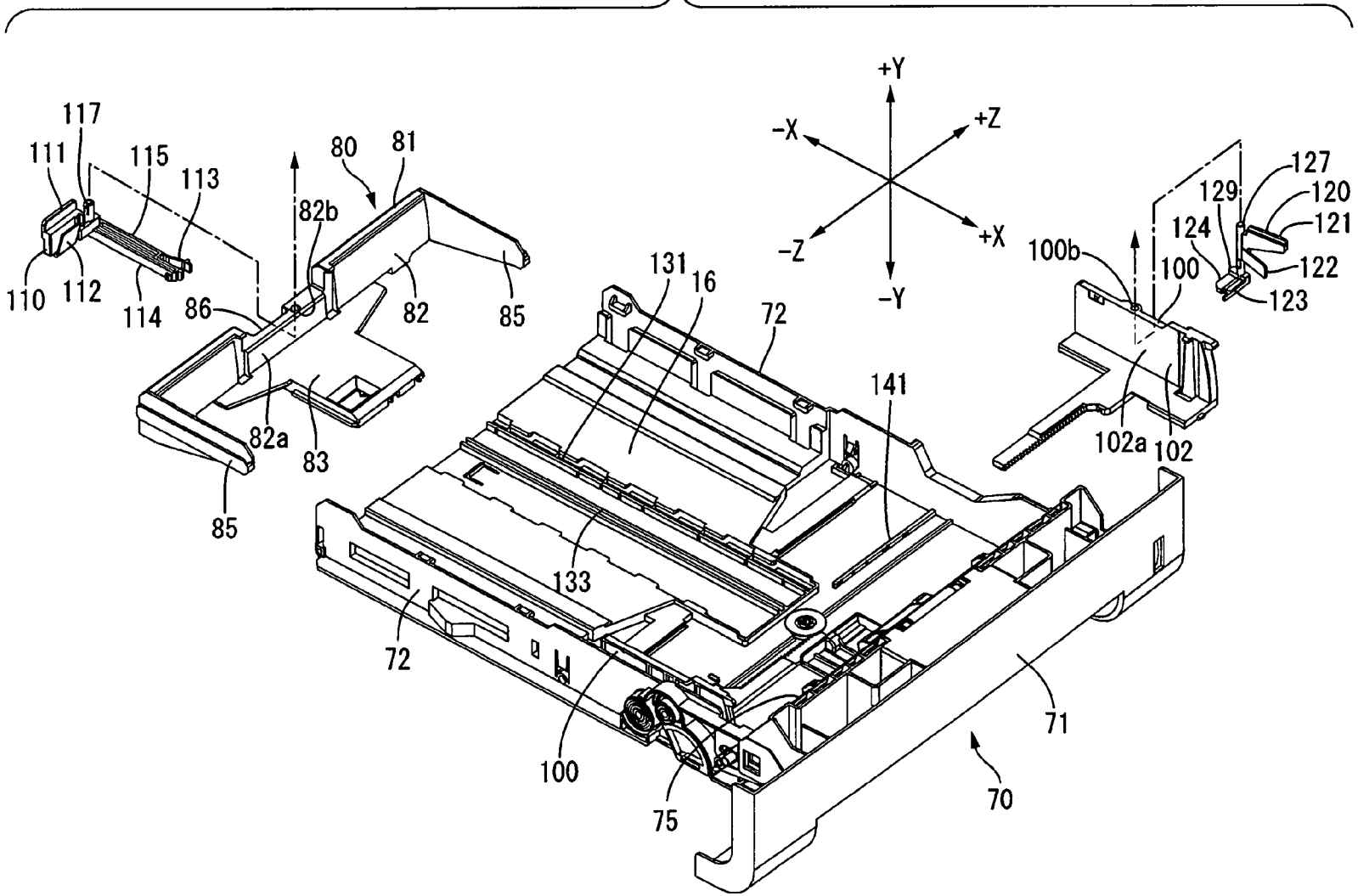
FIG. 11 is an exploded perspective view showing an exploded internal state of a second tray and that of a side guide.
Figure 12:
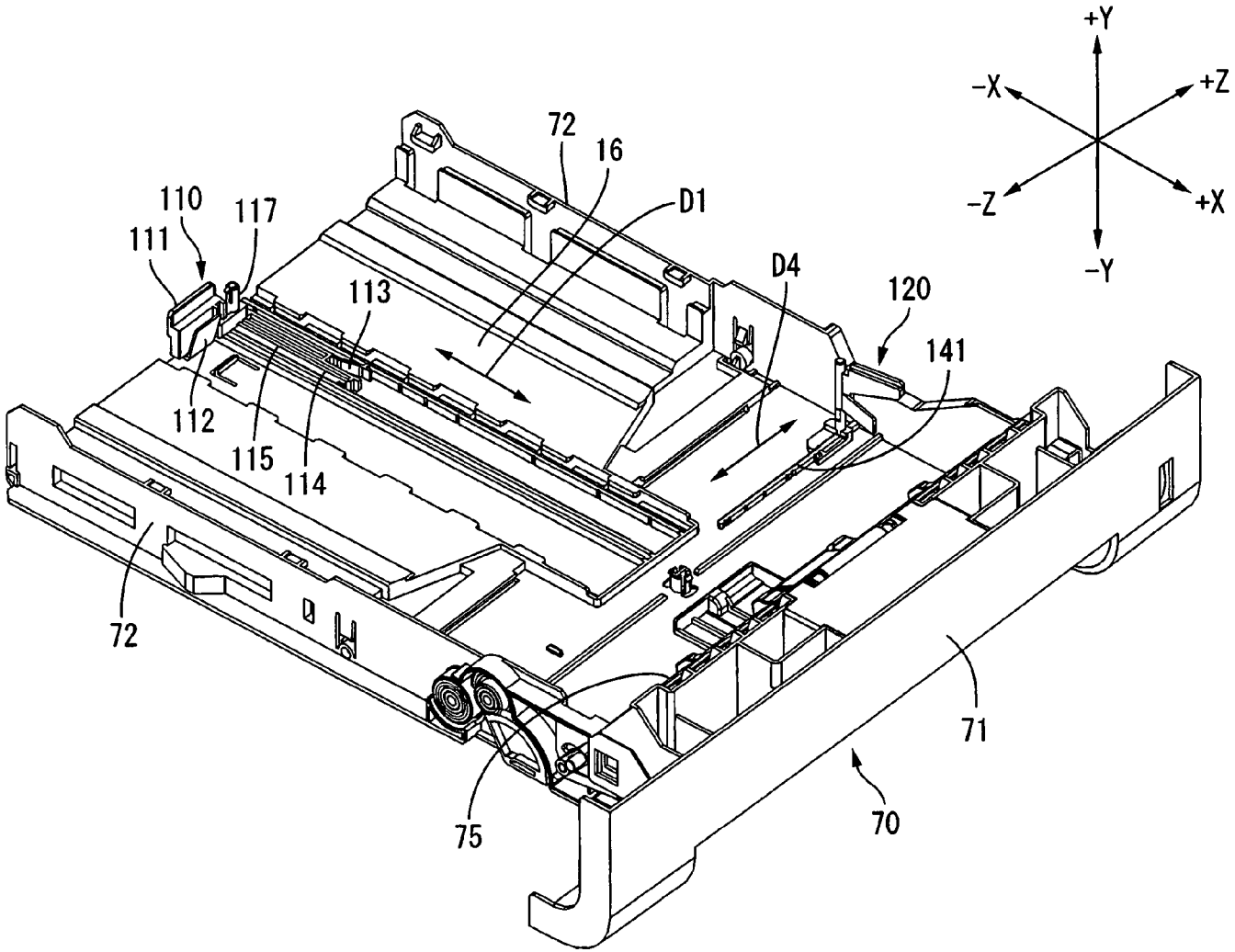
FIG. 12 is a perspective view showing engagement between a first regulatory member, a second regulatory member, and a first tray main body.
Figure 13:
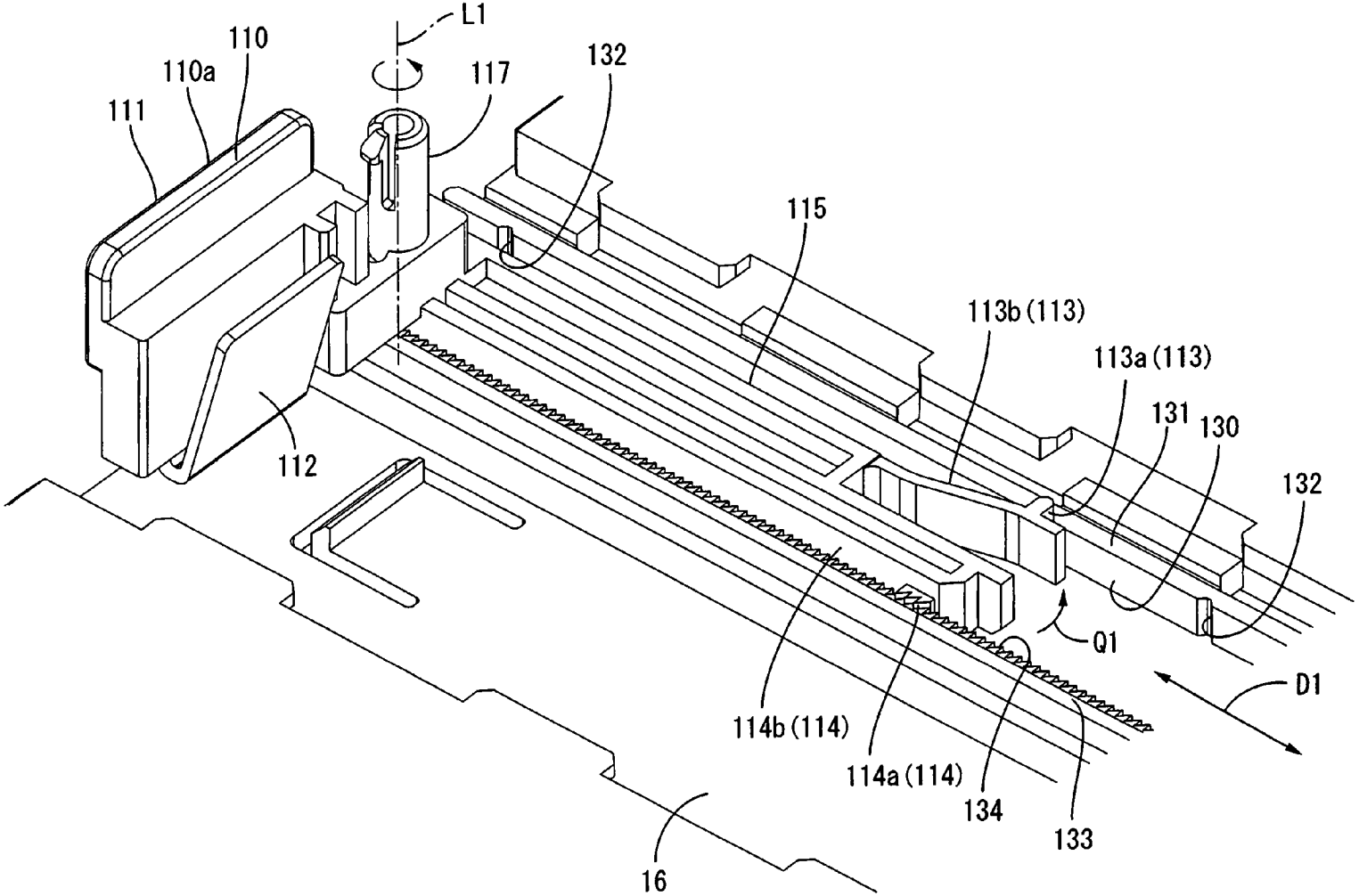
FIG. 13 is a descriptive view showing engagement between the first regulatory member and the first tray main body.
Figure 14A:
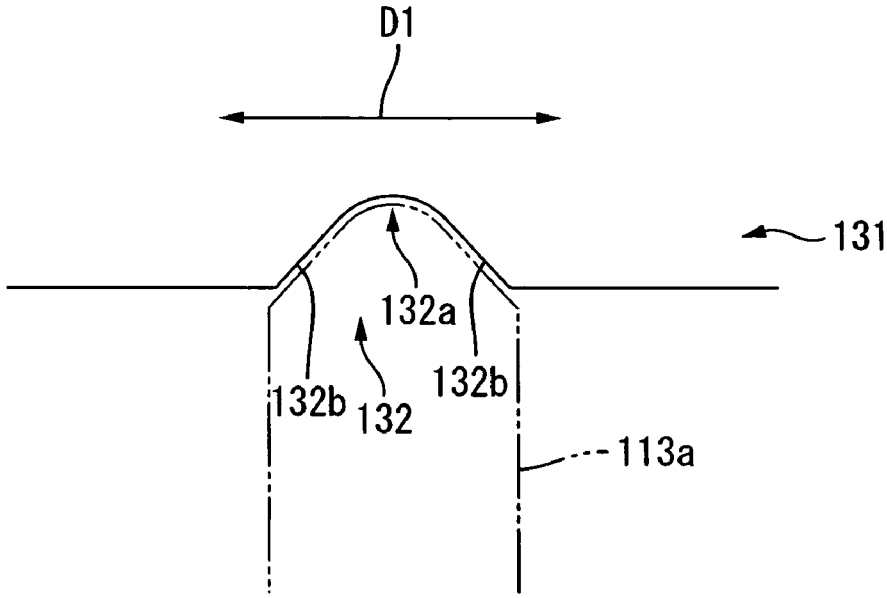
FIGS. 14A and 14B are descriptive views for describing a first recess section and a second recess section, which are objects of engagement of the first regulatory member.
Figure 14B:
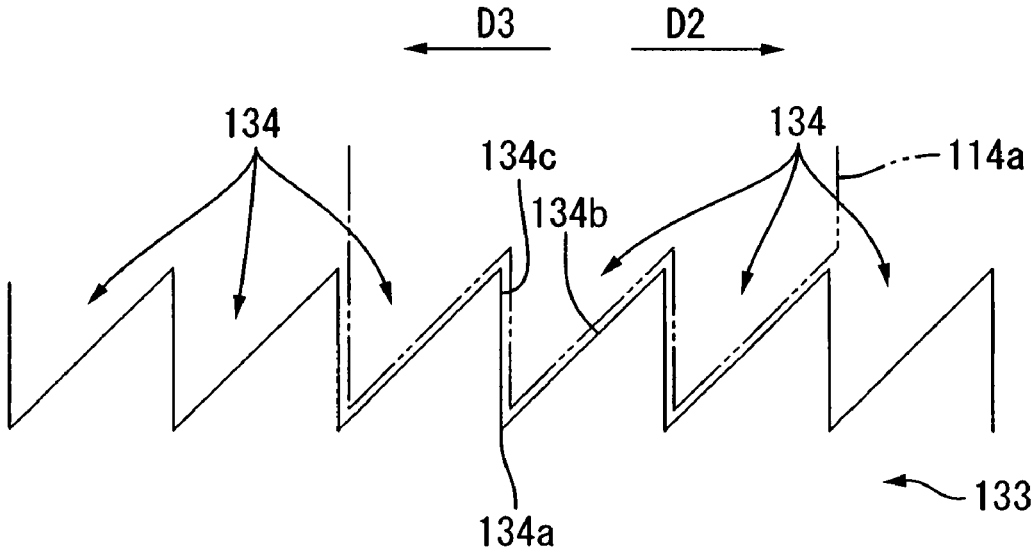
Figure 15:
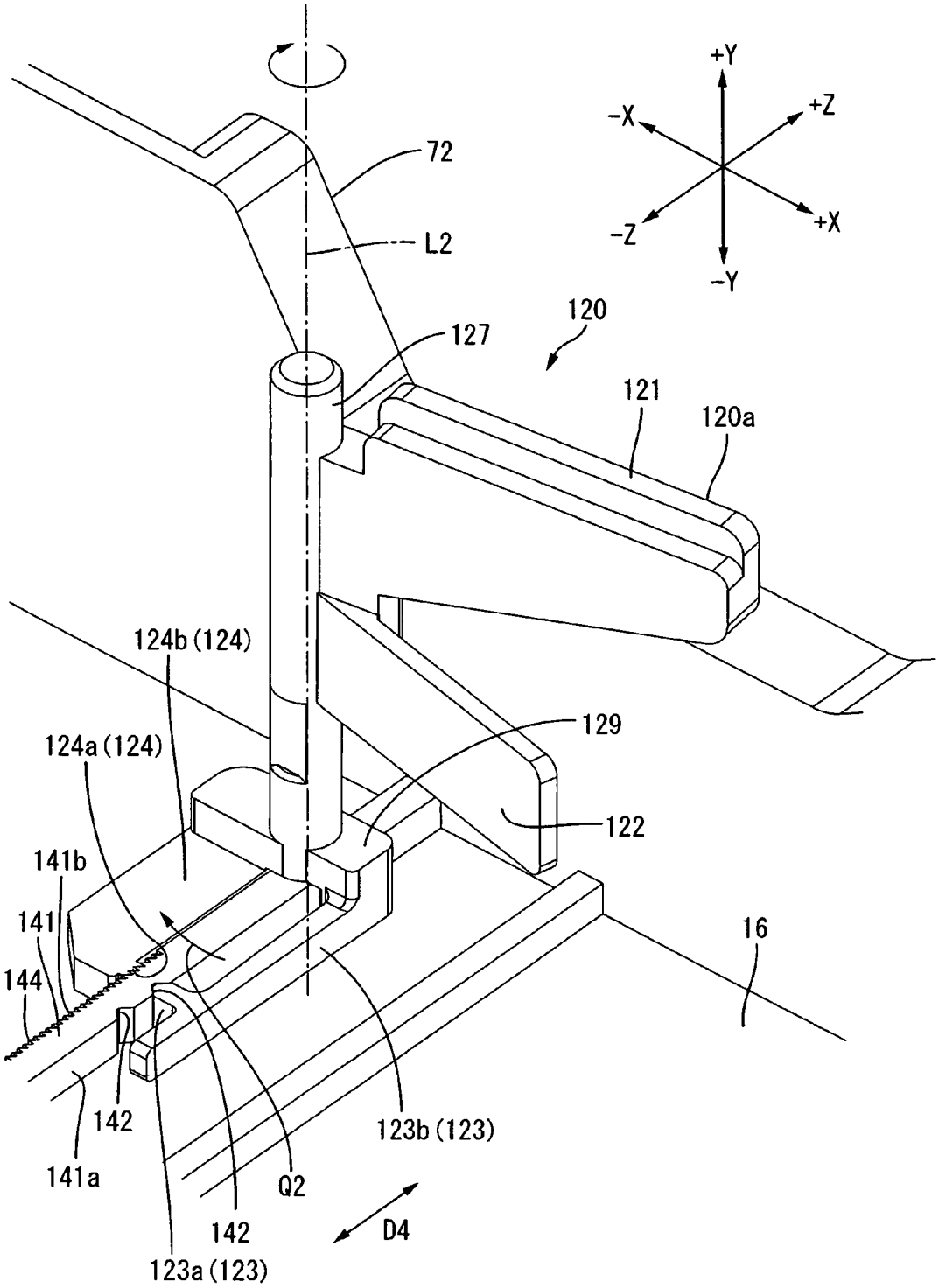
FIG. 15 is a descriptive view showing engagement between the second regulatory member and the first tray main body.
Figure 16:
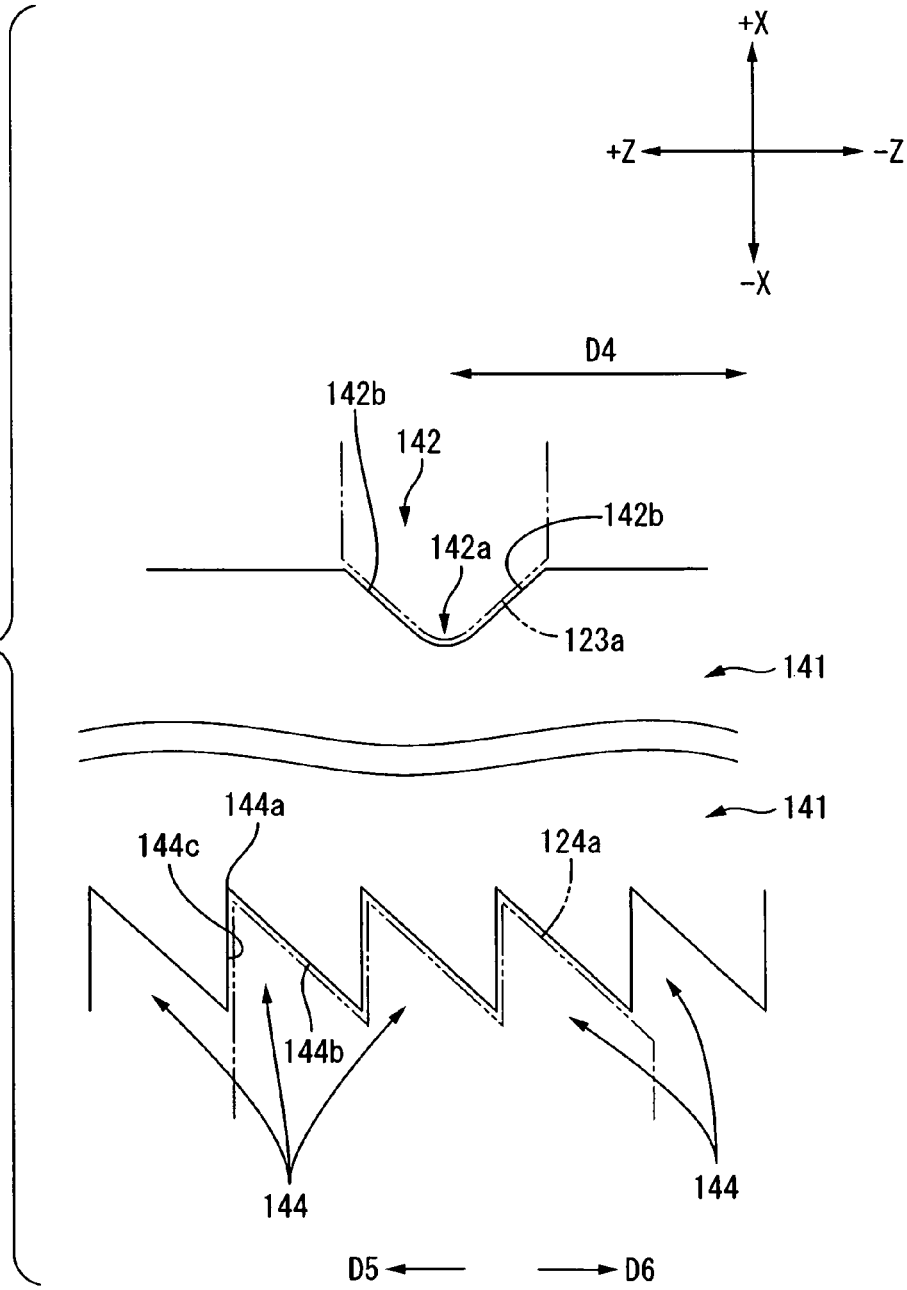
FIG. 16 is a descriptive view for describing the first and second recess sections which are objects of engagement of the second regulatory member.

FIG. 9 shows a perspective view of the paper-feeding cassette when viewed from a downstream position in the paper-feeding direction, and FIG. 10 shows a perspective view of the paper-feeding cassette when viewed from an upstream position in the paper-feeding direction. FIG. 11 is an exploded perspective view showing the inside of the second tray and that of the side guide in an exploded manner, and FIG. 12 is a perspective view showing engagement between a first regulatory member 110, a second regulatory member 120, and a first tray main body 71. FIG. 13 is a descriptive view showing engagement between the first regulatory member 110 and the first tray main body 71, and FIGS. 14A and 14B are descriptive views showing a first recess section and a second recess section, which are to be engaged by the first regulatory member 110. FIG. 15 is a descriptive view showing engagement between a second regulatory member 120 and the first tray main body 71, and FIG. 16 is a descriptive view for describing the first and second recess sections which are to be engaged by the second regulatory member 120.

As shown in FIG. 9, in the present embodiment, the above-described first tray main body 71 (the first tray main body 71 corresponds to a loading member) capable of loading the plurality of sheets 3 is provided. As shown in FIG. 10, the first regulatory member 110 and the second regulatory member 120, which regulate the position of the sheets, are provided while being coupled to the first tray main body 71. The first regulatory member 110 is attached to the second tray main body 81, and the second regulatory member 120 is attached to the side guide 100, thereby positioning the second tray main body 81 and the side guide 100. The second tray main body 81 and the side guide 100 correspond to guide members. The first regulatory member 110 and the second regulatory member correspond to the regulatory members.

First, a relationship between the first regulatory member 110 and the first tray main body 71 will be described. As illustrated by the exploded perspective view in FIG. 11, the first regulatory member 110 is attached to the second tray main body 81 from below, and the first regulatory member 110 is configured to move integrally with the second tray main body 81. Meanwhile, as shown in FIG. 12, the first regulatory member 110 is configured to engage with a portion of the bottom section 16 of the first tray main body 71. A cutout 86 used for exposing an operation section 111, which will be described later, is formed in the second tray main body 81. The second tray main body 81 is assembled such that an operation surface of the operation section 111 is exposed outside by way of the cutout 86. As shown in FIG. 11, a hole 82*b* used for insertion of a shaft section 117 formed on the first regulatory member 110 is formed in the second tray main body 81. As shown in FIG. 9, as a result of the shaft section 117 being inserted into the hole 82*b*, relative movement of the first regulatory member 110 with respect to the second tray main body 81 in a direction orthogonal to the axial line L1 (shown in FIG. 13, and which will be described later) is constrained, and pivotal movement of the first regulatory member 110 about the axis line L1 is allowed.

As shown in FIG. 13 in an enlarged manner, the first tray main body 71 is provided with a plurality of first recess sections 132 (corresponding to first engaging sections) provided at intervals corresponding to the sizes of sheets to be loaded, and second recess sections 134 (corresponding to second engaging sections) provided at intervals smaller than those of the first recess sections 132. The second recess sections 134 are formed at considerably small intervals and into a sawtooth shape. The first regulatory member 110 is provided with the displaceable operation section 111 which is operated at the time of movement of the first regulatory member 110 (i.e., at the time of movement of the second tray 80). This operation section is configured to be compressingly operated so as to approach a second wall section 82 of the second tray main body 81.

Specifically, an urging section 112, which is formed integrally with the operation section 110 and is elastically deformable, remains in contact with the back surface of the second wall section 82 opposite a wall surface 82*a* thereof. The operation section 110 and the second wall section 82 are operated so as to be compressed from their exterior surfaces. Thereby, the operation section 110 is displaced so as to approach the second wall section 82, and the entirety of the first regulatory member 110 pivots about the axial line L1 in association with displacement of the operation section 110. By means of this pivotal movement, a second engaged section 114 is displaced in a direction so as to be disengaged from the second recess section 134. As shown in FIG. 9, in the present embodiment, compressing operation is performed so as to press the wall surface 82*a* and the operation surface 110*a*. The compressing direction (a direction P1 in which the operation surface 110*a* is pressed during operation or a direction P2 in which the wall surface 82*a* is pressed) required when operation for compressing the operation section 110 and the second tray main body 81 is performed is made identical with the moving direction (the direction of arrow D1) of the first regulatory member (i.e., the direction of the X axis). Here, the identical direction is a concept including an essentially-identical direction.

As shown in FIG. 13, the first regulatory member 110 is provided with an arm section 115 extending downward from the shaft section 117 in the paper-feeding direction. This arm section 115 is further provided with an elastically-deformable first arm 113*b* and a second arm 114*b* which hardly undergoes elastic deformation. The first arm section 113*b* is provided with a first protuberance section 113*a* formed so as to be able to engage with any of the first recess sections 132, and the second arm 114*b* is provided with a second protuberance section 114*a* formed so as to be able to engage with the second recess sections 134.

In the first regulatory member 110, a first engaged section 113 is formed from the first arm 113*b* and the first protuberance section 113*a*, both of which are configured as mentioned above. The second engaged section 114 is formed from the second arm 114*b* and the second protuberance section 114*a*. The first regulatory member 110 is formed integrally from resin material.

The first engaged section 113 and the second engaged section 114 are respectively configured so as to extend in the moving direction of the first regulatory member 110, and are coupled together by means of the arm section 115 formed integrally with the shaft section 117. The first engaged section 113 and the second engaged section 114 are formed so as to integrally pivot about the shaft section 117 (more specifically, the center of the pivotal axis line L1) by way of the arm section 115 in accordance with displacement of the operation section 111. The arm section 115 corresponds to a coupling section.

A groove section 130 formed from a rib-shaped first side wall 131 and a rib-shaped second side wall 133 is formed in the first tray main body 71. The groove section 130 extends in the moving direction of the first regulatory member 110, and the first engaged section 113 and the second engaged section 114 are formed to be housed in the groove section 130. The first engaged section 113 and the second engaged section 114 are formed so as to pivot integrally with the shaft section 117 according to displacement of the operation section 111. The previously-described first recess sections 132 are formed at a downstream position in the pivoting direction (the direction of arrow Q1) of the groove section, and the previously-described second recess section 134 is provided at an upstream position in the pivoting direction. The first engaged section 113 is urged toward the first sidewall 131 by means of the pivotal operation corresponding to displacement of the operation section 111. Meanwhile, the second engaged section 114 is displaced toward a side where the second engaged section 114 goes out of the second side wall 133.

Specifically, the second engaged section 114 is displaced in a direction so as to disengage from the second recess section 134 in accordance with displacement of the operation section 111. The first engaged section 113 is elastically deformed such that the urging force exerted on the first recess section 132 becomes stronger, in conjunction with the second engaged section 114 in accordance with displacement of the operation section 111. More specifically, the shaft section 117 pivots about the axial line L1 in accordance with displacement of the operation section 111. The first engaged section 113 and the second engaged section 114, which are formed integrally with the shaft section 117, pivot in the direction of arrow Q. By means of such pivotal movement, the first arm 113*b* is elastically deformed with the neighborhood of the first protuberance section 113*a* remaining in contact with the first sidewall 131. By means of such elastic deformation, the first protuberance section 113*a* is urged toward the first recess section 132.

FIG. 14A shows the neighborhood of the first recess section 132 when viewed from above. The first recess section 132 is provided with a deepest section 132*a* where the largest depth is achieved. Slope sections 132*b*, 132*b*, whose exterior surfaces are inclined with respect to the moving direction of the first protuberance section 113*a*, are provided on both sides of the deepest section 132*a* in the moving direction of the first protuberance section 113*a* (a section designated by a broken line shown in FIG. 14A). The slope section 132*b* is formed such that the depth becomes smaller with increasing distance, in the moving direction [the direction of arrow D1 (the direction of the X axis)], from the deepest section 132*a* of the first recess section 132. More specifically, the slope section 132*b* is configured to be able to effect tentative holding and to be easily released from the engaged state in accordance with movement of the first protuberance section 113*a*. Tentative holding does not hinder movement of the first regulatory member.

As shown in FIG. 13, the second arm 114*b* in the second engaged section 114 is configured to be substantially resistant to elastic deformation. The second protuberance section 114*a* is fully disengaged from the second recess section 134 by means of pivotal movement in the direction of arrow Q stemming from displacement of the operation section 111. Specifically, the entirety of the second engaged section 114 is formed to be thicker than the first engaged section 113, and is less susceptible to deformation than is the first engaged section 113. Consequently, engagement between the second engaged section 114 and the second recess section 134 becomes stronger than engagement between the first engaged section 113 and the first recess section 132, and stable positioning is performed.

As shown in FIG. 14B, the second recess section 134 is also provided with a slope section 134*b* in a direction where the second tray main body 81 approaches the sheets [i.e., the direction of arrow D2 (the direction of a +X)] with respect to the deepest section 134*a* of the second recess section 134. An exterior surface of the slope section 134*b* is inclined in the moving direction of the second protuberance section 114*a* [i.e., directions of arrows D2, D3 (the direction of the X axis)], and the slope section 134*b* is formed such that a depth becomes smaller with increasing distance, in the moving direction (the directions of arrows D2, D3) from the deepest section 134*a*. The deepest section 134*a* of the second recess section 134 is provided, in the direction where the second tray main body 81 goes away from the sheets [i.e., the direction of arrow D3 (the direction of a −X)], with an orthogonal section 134*c* whose exterior surface is orthogonal to the moving direction (the directions of arrows D2, D3). By means of this configuration, when the second tray main body 81 serving as a guide member moves in a direction so as to approach the sheets, the second protuberance section 114*a* and the second recess section 134 are easily disengaged from each other. Meanwhile, even when the second tray main body 81 attempts to move in a direction so as to go away from the sheets, movement of the second protuberance section 114*a* is regulated by the contact between the second protuberance section 114*a* and the orthogonal section 134*c*. Hence, the second tray main body 81 does not move in a direction so as to go away from the sheets, and the sheets can be stably guided to a predetermined position. Further, even when the regulatory member attempts to move in a direction so as to approach the sheets, the movement is prohibited by the sheets, and hence movement of the regulatory member to the inside (i.e., toward the sheets) is also stably regulated.

As shown in FIG. 13, the first engaged section 113 and the second engaged section 114 are formed in positions on the first regulatory member 110 closer to the sheets (i.e., the inside of the sheet housing section 90) than to the operation section 111 in the moving direction [the direction of arrow D1 (i.e., the direction of the X axis)] of the first regulatory member 110. Consequently, when compared with the case where the first engaged section 113 and the second engaged section 114 are provided in positions outside of the operation section 111 (i.e., positions opposite the sheets with respect to the operation section 111), the sheet-feeding cassette can be made compact.

As mentioned previously, the first regulatory member 110 is provided with the urging section 112 which, upon contact with the second wall section 82, urges the operation section 111 in a returning direction against displacement action stemming from operation of the operation section 111. As a result, after operation of the operation section 111, the operation section 111 quickly returns to its original position under the urging force of the urging section 112. When operation of the operation section 111 is canceled, the first regulatory member 110 is less likely to become unstable, and pivotal movement in the direction opposite that of arrow Q1 arises, whereupon the first regulatory member is positioned immediately.

2. Positioning of the First Tray Main Body and Side Guides

A relationship between the second regulatory member 120 and the first tray main body 71 will now be described. As can be seen from the exploded perspective view of FIG. 11, the second regulatory member 120 is attached to the side guide 100 from below and is configured to move along with the side guide 100. As shown in FIG. 12, the second regulatory member 120 is configured to engage with a portion of the bottom plate 16 of the first tray main body 71. As shown in FIG. 11, a hole 100*b* used for inserting a shaft section 127 formed on the second regulatory member 120 is formed in the side guide 100. As shown in FIGS. 9 and 10, as a result of the shaft section 127 being inserted into the hole 100*b*, relative movement of the second regulatory member 120 with respect to the side guide 100 in the direction orthogonal to an axial line L2 (see FIG. 15, and which will be described later) is constrained, and pivotal movement of the second regulatory member 120 about the axial line L2 is allowed.

As shown in enlarged view in FIG. 15, the first tray main body 71 is provided with a plurality of first recess sections 142 (corresponding to the first engaging sections) provided at intervals corresponding to sizes of sheets to be loaded, and second recess sections 144 (corresponding to the second engaging sections) provided at intervals which are smaller than those of the recess sections 142. The second recess sections 144 are formed into a sawtooth pattern at considerably short intervals. The second regulator member 120 is provided with the operation section 121 which can be displaced during movement of the second regulatory member 120 (during movement of the side guide 100). This operation section 121 is configured to be compressingly operated so as to approach the wall section 102 (see FIG. 11) of the side guide 100.

Specifically, the elastically-deformable urging section 112 formed integrally with the operation section 120 remains in contact with a back surface of the wall section 102 opposite a wall surface 102*a* thereof. Operation is performed so as to compress the operation section 120 and the wall section 102, whereby the operation section 120 is displaced to approach the wall section 102. In association with this displacement, the entirety of the second regulatory member 120 pivots about the axial line L2 to be described later. By means of such pivotal movement, the second engaged section 124 is displaced in a direction so as to be disengaged from the second recess section 144 (in the direction of arrow Q2). As shown in FIGS. 9 and 10, in the present embodiment, the compressing operation is performed so as to press the wall surface 102*a* and the operation surface 120*a*. The compressing direction (the direction where the operation section 120*a* is pressed during operation or the direction where the wall surface 102*a* is pressed) achieved during operation for compressing the operation section 120 and the side guide 100 is made essentially equal to the moving direction of the second regulatory member (the direction of arrow D4) (i.e., the direction of the Z axis).

As shown in FIG. 15, in the second regulatory member 120, a base end section 129 of the shaft section 127 is provided with an elastically-deformable first arm 123*b* and a second arm 124*b* which is hardly elastically deformed. The first arm 123*b* is provided with a first protuberance section 123*a* formed to be able to engage with the first recess section 142. The second arm 124*b* is provided with a second protuberance section 124*a* which is configured to be able to engage with the second recess section 144.

In the second regulatory member 120, the first arm 123*b* and the first protuberance section 123*a*, which are formed as mentioned above, constitute the first engaged section 123. The second engaged section 124 is constituted of the second arm 124*b* and the second protuberance section 124*a*. The second regulatory member 120 is formed integrally from a resin material.

The first engaged section 123 and the second engaged section 124 are configured to extend in the moving direction (the direction of D4) of the second regulatory member 120, and are coupled together by the base end section 129 formed integrally with the shaft member 127. The first engaged section 123 and the second engaged section 124 are configured to integrally pivot about the shaft section 127 (more specifically, the pivotal line L2) by way of the base end section 129 in accordance with displacement of the operation section 121. The base end section 129 corresponds to the coupling section defined in claims.

The first tray main body 71 has a pedestal section 141 in the position sandwiched between the first engaged section 123 and the second engaged section 124, wherein the pedestal section 141 extends along the moving direction of the second regulatory member 120 (the direction of D4). This pedestal section 141 has a first sidewall 141*a* which is disposed opposite the first engaged section 123 and provided with the first recess sections 142, and a second sidewall 141*b* which is disposed opposite the second engaged section 124 and provided with the second recess sections 144. The first engaged section 123 and the second engaged section 124 are configured to integrally pivot in accordance with displacement of the operation section 121. With respect to the pivotal direction, the first engaged section 123 is located upstream, and the second engaged section 124 is positioned downstream. By means of pivotal action, the first engaged section 123 is urged toward the first sidewall 141*a*, and the second engaged section 124 is displaced in a direction so as to go away from the second side wall 141*b*.

Meanwhile, the second regulatory member 120 is provided with an urging section 122 which urges, upon contact with the wall section 102, the operation section 120 in a returning direction against displacement stemming from operation of the operation section 121. As a result, after operation of the operation section 121, the operation section quickly returns to its original position under the urging force of the urging section 122. When operation of the operation section 121 is canceled, the second regulatory member 120 is less likely to become unstable, and pivotal movement in the direction opposite that of arrow Q2 arises, whereupon the first regulatory member is positioned immediately.

As shown in FIG. 15, the first engaged section 123 and the second engaged section 124 are formed in positions on the second regulatory member 120 closer to the sheets (i.e., the inside of the sheet housing section 90) than to the operation section 121 in the moving direction [the direction of D4 (i.e., the direction of the Z axis)] of the second regulatory member 120. Consequently, when compared with the case where the first engaged section 123 and the second engaged section 124 are provided in positions outside of the operation section 121 (i.e., positions opposite the sheets with respect to the operation section 121), the sheet-feeding cassette can be made compact.

FIG. 16 shows the neighborhood of the pedestal section 141 when viewed from above. The first recess section 142 is provided with a deepest section 142*a* where the largest depth is achieved. Slope sections 142*b*, 142*b*, whose exterior surfaces are inclined with respect to the moving direction of the first protuberance section 123*a*, are provided on both sides of the deepest section 142*a* in the moving direction (the direction of D4) of the first protuberance section 123*a* (a section designated by a broken line shown in FIG. 16). The slope section 142*b* is formed such that the depth becomes smaller with increasing distance, in the moving direction [the direction of arrow D4 (the direction of the Z axis)], from the deepest section 142*a* of the first recess section 142. More specifically, the slope section 142*b* is configured to be able to effect tentative holding and to be easily released from the engaged state in accordance with movement of the first protuberance section 123*a*. Tentative holding does not hinder movement of the first regulatory member.

As shown in FIG. 15, the second arm 124*b* in the second engaged section 124 is configured to be substantially resistant to elastic deformation. The second protuberance section 124*a* is fully disengaged from the second recess section 144 by means of pivotal movement in the direction of arrow Q2 stemming from displacement of the operation section 121. Specifically, the entirety of the second engaged section 124 is formed to be thicker than the first engaged section 123, and is less susceptible to deformation than is the first engaged section 123. Consequently, engagement between the second engaged section 124 and the second recess section 144 becomes stronger than engagement between the first engaged section 123 and the first recess section 142, and stable positioning is performed.

As shown in FIG. 16, the second recess section 144 is also provided with a slope section 144*b* in a direction where the side guide 100 approaches the sheets [i.e., the direction of arrow D6 (the direction of a −Z)] with respect to the deepest section 144*a* of the second recess section 144. An exterior surface of the slope section 144*b* is inclined in the moving direction of the second protuberance section 124*a* (i.e., directions of arrow D6), and the slope section 144*b* is formed such that a depth becomes smaller with increasing distance, in the moving direction, from the deepest section 144*a*. The deepest section 144*a* of the second recess section 144 is provided, in the direction where the side guide 100 goes away from the sheets [i.e., the direction of arrow D5 (the direction of the −Z)], with an orthogonal section 144*c* whose exterior surface is orthogonal to the moving direction (the direction of arrow D5). By means of this configuration, when the side guide 100 serving as a guide member moves in a direction so as to approach the sheets, the second protuberance section 124*a* and the second recess section 144 are easily disengaged from each other. Meanwhile, even when the side guide 100 attempts to move in a direction so as to go away from the sheets, movement of the second protuberance section 124*a* is regulated by the contact between the second protuberance section 124*a* and the orthogonal section 144*c*. Hence, the side guide 100 does not move in a direction so as to go away from the sheets, and the sheets can be stably guided to a predetermined position.

What is claimed is:

1. An image forming apparatus comprising:

a main body casing; and a sheet-feeding cassette that is removably attached to the main body casing;

wherein the sheet-feeding cassette comprises:

a stacking member being capable of stacking a plurality of sheets, the stacking member including first engaging sections provided at intervals corresponding to sizes of the sheets to be stacked, and second engaging sections provided at intervals which are smaller than those of the first engaging sections; and a regulatory member being movable with respect to the stacking member, the regulatory member regulating the position of the sheets, the regulatory member including an operation section that is operated at the time of movement of the regulatory member and is capable of being displaced, a first engaged section that is capable of engaging with the first engaging sections and is elastically deformable, and a second engaged section that is capable of engaging with the second engaging sections;

wherein the second engaged section is displaced in a direction so as to be disengaged from the second engaging sections in accordance with displacement of the operation section; and the first engaged section is elastically deformed as a result of being interlocked with the second engaged section according to displacement of the operation section, such that urging force exerted on the first engaging sections becomes stronger.

2. The image forming apparatus according to claim 1, further comprising a guide member being movable with respect to the stacking member and guiding the sheet upon contact with the sheet;

wherein the regulatory member is provided on the guide member; and the operation section is compressingly operated so as to come close to the guide member at the time of movement of the regulatory member, so that the second engaged section is displaced to be disengaged from the second engaging sections.

3. The image forming apparatus according to claim 2, wherein the direction of compression exerted on the operation section and the guide member during compression operation is made identical with a moving direction of the regulatory member.

4. The image forming apparatus according to claim 3, wherein the regulatory member is provided with an urging section that urges, upon contact with the guide member, the operation section in a returning direction against displacement resulting from operation of the operation section.

5. The image forming apparatus according to claim 2, wherein a cutout used for exposing the operation section is formed in the guide member.

6. The image forming apparatus according to claim 1, wherein each of the first engaging sections has a first recess section formed in an indented shape, and the first engaged section has a first protuberance section of projecting shape to engage with the first recess section.

7. The image forming apparatus according to claim 6, wherein an exterior surface of the first recess section is formed to become inclined with respect to a moving direction of the first protuberance section, and the first recess section has slope sections provided on both sides of a deepest portion of the first recess section with respect to the moving direction of the first protuberance section; and the slope sections are formed such that a depth of the first recess section becomes smaller with increasing distance, in the moving direction, from the deepest portion of the first recess section.

8. The image forming apparatus according to claim 1, wherein each of the second engaging sections has a second recess section formed into an indented shape; and the second engaged section has a second protuberance sections of projecting shape to engage with the second recess section.

9. The image forming apparatus according to claim 8, wherein the second recess section is provided in a direction in which the regulatory member approaches the sheet with respect to a deepest portion of the second recess section;

the second recess section has a slope section whose exterior surface is formed at an inclination with respect to a moving direction of the second protuberance section and an orthogonal section which is provided in a direction where the regulatory member goes away from the sheet with respect to the deepest portion of the second recess section and whose exterior surface is orthogonal to the moving direction; and the slope section is formed such that a depth of the second recess section becomes smaller with increasing distance, in the moving direction, from the deepest portion of the second recess section.

10. The image forming apparatus according to claim 1, wherein the regulator member has a coupling section for coupling the first engaged section to the second engaged section;

the first engaged section and the second engaged section are respectively formed so as to extend in a moving direction of the regulatory member; and the first engaged section and the second engaged section integrally pivot by way of the coupling section in accordance with displacement of the operation section.

11. The image forming apparatus according to claim 10, wherein the stacking member has a pedestal section which is located in a position sandwiched between the first engaged section and the second engaged section and which extends in the moving direction of the regulatory member, the pedestal section including a first sidewall that opposes the first engaged section and is provided with the first engaging sections, and a second sidewall that opposes the second engaged section and is provided with the second engaging sections;

the first and second engaged sections are configured to pivot integrally in accordance with displacement of the operation section, and the second engaged section is provided downstream of the first engaged section with respect to a pivotal direction; and the first engaged section is urged toward the first sidewall by means of the pivotal action, whilst the second engaged section is displaced in a direction moving away from the second sidewall.

12. The image forming apparatus according to claim 10, wherein the stacking member has a groove section which extends in the moving direction of the regulatory member and houses the first and second engaged sections, the groove section including a first sidewall that opposes the first engaged section and has the first engaging sections, and a second sidewall that opposes the second engaged section and has the second engaging sections;

the first and second engaged sections are configured to pivot integrally in accordance with displacement of the operation section, and the second engaged section is provided upstream of the first engaged section with respect to a pivotal direction; and the first engaged section is urged toward the first sidewall by means of a pivotal action, whilst the second engaged section is displaced in a direction moving away from the second sidewall.

13. The image forming apparatus according to claim 1, wherein the second engaged section is thicker than the first engaged section.

14. The image forming apparatus according to claim 1, wherein the first and second engaged sections are formed at positions closer to the sheet than to the operation section with respect to the moving direction of the regulatory member.

15. The image forming apparatus according to claim 1, wherein the regulatory member is formed integrally from a resin material.

16. A sheet-feeding cassette comprising:

a stacking member being capable of stacking a plurality of sheets, the stacking member including first engaging sections provided at intervals corresponding to sizes of the sheets to be stacked, and second engaging sections provided at intervals which are smaller than those of the first engaging sections; and a regulatory member being movable with respect to the stacking member, the regulatory member regulating the position of the sheets, the regulatory member including an operation section that is operated at the time of movement of the regulatory member and is capable of being displaced, a first engaged section that is capable of engaging with the first engaging sections and is elastically deformable, and a second engaged section that is capable of engaging with the second engaging sections;

wherein the second engaged section is displaced in a direction so as to be disengaged from the second engaging sections in accordance with displacement of the operation section; and the first engaged section is elastically deformed as a result of being interlocked with the second engaged section according to displacement of the operation section, such that urging force exerted on the first engaging sections becomes stronger.

17. The sheet-feeding cassette according to claim 16, further comprising a guide member being movable with respect to the stacking member and guiding the sheet upon contact with the sheet;

wherein the regulatory member is provided on the guide member; and the operation section is compressingly operated so as to come close to the guide member at the time of movement of the regulatory member, so that the second engaged section is displaced to be disengaged from the second engaging sections.

18. The sheet-feeding cassette according to claim 16, wherein the stacking member has a pedestal section which is located in a position sandwiched between the first engaged section and the second engaged section and which extends in the moving direction of the regulatory member, the pedestal section including a first sidewall that opposes the first engaged section and is provided with the first engaging sections, and a second sidewall that opposes the second engaged section and is provided with the second engaging sections;

the first and second engaged sections are configured to pivot integrally in accordance with displacement of the operation section, and the second engaged section is provided downstream of the first engaged section with respect to a pivotal direction; and the first engaged section is urged toward the first sidewall by means of the pivotal action, whilst the second engaged section is displaced in a direction moving away from the second sidewall.

19. The sheet-feeding cassette according to claim 16, wherein the stacking member has a groove section which extends in the moving direction of the regulatory member and houses the first and second engaged sections, the groove section including a first sidewall that opposes the first engaged section and has the first engaging sections, and a second sidewall that opposes the second engaged section and has the second engaging sections;

the first and second engaged sections are configured to pivot integrally in accordance with displacement of the operation section, and the second engaged section is provided upstream of the first engaged section with respect to a pivotal direction; and the first engaged section is urged toward the first sidewall by means of a pivotal action, whilst the second engaged section is displaced in a direction moving away from the second sidewall.

* * * * *